US011274523B2

(12) United States Patent
Galindo et al.

(10) Patent No.: US 11,274,523 B2
(45) Date of Patent: Mar. 15, 2022

(54) VARIABLE TORQUE FLAPPER VALVE

(71) Applicant: HALLIBURTON ENERGY SERVICES, INC., Houston, TX (US)

(72) Inventors: Abram Serda Galindo, Carrollton, TX (US); James Dan Vick, Jr., Dallas, TX (US); Leo Guadalupe Collins, Farmers Branch, TX (US); Russell Irving Bayh, Carrollton, TX (US); Jimmie Robert Williamson, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 5 days.

(21) Appl. No.: 16/636,405

(22) PCT Filed: May 29, 2019

(86) PCT No.: PCT/US2019/034364
§ 371 (c)(1),
(2) Date: Feb. 4, 2020

(87) PCT Pub. No.: WO2020/242465
PCT Pub. Date: Dec. 3, 2020

(65) Prior Publication Data
US 2021/0156226 A1 May 27, 2021

(51) Int. Cl.
*E21B 34/14* (2006.01)
*E21B 34/12* (2006.01)

(52) U.S. Cl.
CPC ..... *E21B 34/14* (2013.01); *E21B 34/12* (2013.01); *E21B 2200/05* (2020.05)

(58) Field of Classification Search
CPC .. E21B 34/14; E21B 2200/00; E21B 2200/05; E21B 34/12
See application file for complete search history.

(56) References Cited

U.S. PATENT DOCUMENTS 1,818,508 A * 8/1931 Scott ..... E21B 21/106
251/149.2
2,735,498 A * 2/1956 Muse ..... E21B 21/10
166/317

(Continued)

FOREIGN PATENT DOCUMENTS

FR 2839354 A1 11/2003
WO WO 2015/020634 A1 2/2015
WO WO 2016/133497 8/2016

OTHER PUBLICATIONS

International Search Report and Written Opinion mailed for International Application No. PCT/US2019/034355, dated Feb. 27, 2020, ISA/KR, 11 pages.

(Continued)

*Primary Examiner* — Michael R Wills, III
(74) *Attorney, Agent, or Firm* — Haynes and Boone, LLP

(57) ABSTRACT

A flapper valve assembly including a tubular forming an interior passageway; a valve seat forming a portion of the interior passageway; a flapper plate that is pivotably mounted to the tubular at a pivot point such that the flapper plate is pivotable between a valve closed and a valve open position; and a spring engaging the flapper plate such that the flapper plate is biased towards the valve closed position; wherein, when the flapper plate is in the valve open position, the spring engages a top of the flapper plate at a first distance from the pivot point; wherein, when the flapper plate is in the valve closed position, the spring engages the top of the flapper plate at a second distance from the pivot point; and wherein the second distance is greater than the first distance.

19 Claims, 28 Drawing Sheets

(56) References Cited

U.S. PATENT DOCUMENTS

| | | | | |
|---|---|---|---|---|
| 4,196,745 | A | 4/1980 | Gerhard | |
| 5,145,005 | A | 9/1992 | Dollison | |
| 5,310,005 | A | 5/1994 | Dollison | |
| 6,227,299 | B1 | 5/2001 | Dennistoun | |
| 6,328,062 | B1 | 12/2001 | Williams et al. | |
| 7,021,386 | B2 | 4/2006 | Vick, Jr. et al. | |
| 7,600,534 | B2 * | 10/2009 | Deaton | E21B 34/06 137/527 |
| 7,708,066 | B2 * | 5/2010 | Frazier | E21B 34/14 166/250.08 |
| 7,798,235 | B2 * | 9/2010 | Mondelli | E21B 34/10 166/373 |
| 2007/0246218 | A1 | 10/2007 | Vick, Jr. et al. | |
| 2009/0151924 | A1 * | 6/2009 | Lake | F16K 31/002 166/53 |
| 2014/0124212 | A1 | 5/2014 | Slup | |
| 2016/0177668 | A1 * | 6/2016 | Watson | E21B 34/14 166/373 |
| 2016/0222757 | A1 | 8/2016 | Brimer et al. | |
| 2017/0226823 | A1 | 8/2017 | Ng | |
| 2018/0016866 | A1 | 1/2018 | Caminari | |

OTHER PUBLICATIONS

International Search Report and Written Opinion mailed for International Application No. PCT/US2019/034364, dated Feb. 27, 2020, ISA/KR, 10 pages.

Search Report issued for French Patent Application No. FR2003378, dated Sep. 24, 2021, 10 pages (17 pages with translation).

* cited by examiner

VARIABLE TORQUE FLAPPER VALVE

CROSS-REFERENCE TO RELATED APPLICATION

The present application is a U.S. National Stage patent application of International Patent Application No. PCT/US2019/034364, filed on May 29, 2019, the benefit of which is claimed and the disclosure of which is incorporated herein by reference in its entirety.

TECHNICAL FIELD

The present disclosure generally relates to oilfield equipment and, in particular, to materials used in downhole tools and wellbore systems. More particularly still, the present disclosure relates to methods and systems for operating a downhole valve, such as a downhole flapper valve.

BACKGROUND

Surface controlled, subsurface safety valves are commonly used to shut in oil and gas wells in the event of a failure or hazardous condition at the well surface. Such safety valves are typically fitted into the production tubing and operate to block the flow of formation fluid upwardly therethrough. The subsurface safety valve provides shutoff of production flow in response to a variety of out-of-range safety conditions that can be sensed or indicated at the surface. For example, the out-of-range safety conditions may include a fire on the platform, a high or low flow line temperature or pressure condition, or operator override.

During production, a hydraulically operated subsurface safety valve is typically held open by the application of hydraulic fluid pressure via an auxiliary control conduit that extends along the tubing string within an annulus between the tubing and the well casing. Flapper type subsurface safety valves utilize a closure plate which is actuated by longitudinal movement of a hydraulically actuated operator tube system, which can be a rod-style piston, a concentric tubular piston, or in the case of an electrically operated subsurface safety valve, an electro-mechanical operator. The flapper valve closure plate is maintained in the valve open position by an operator tube which is extended by the application of hydraulic pressure onto the piston. Upon removal of the operator tube from the flapper plate, the flapper plate is then rotated to the valve closed position by a torsion spring or tension member.

Typically, the flapper closure plate is supported for rotational movement by a hinge assembly that includes a hinge pin and a torsion spring or tension member. Generally, the torsion spring is looped around the hinge pin to urge the flapper valve to the valve closed position. These valves generally require clearance near the pivot pin of the flapper to allow for the torsion spring to be positioned about the pivot pin. Providing this clearance near the pivot pin reduces the size of the hinge pin or surrounding elements of the flapper valve.

The present disclosure is directed to subsurface equipment, such as a flapper valve with a beam spring and methods that overcome one or more of the shortcomings in the prior art.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements. Embodiments are described in detail hereinafter with reference to the accompanying figures, in which.

DETAILED DESCRIPTION

Figure 1:
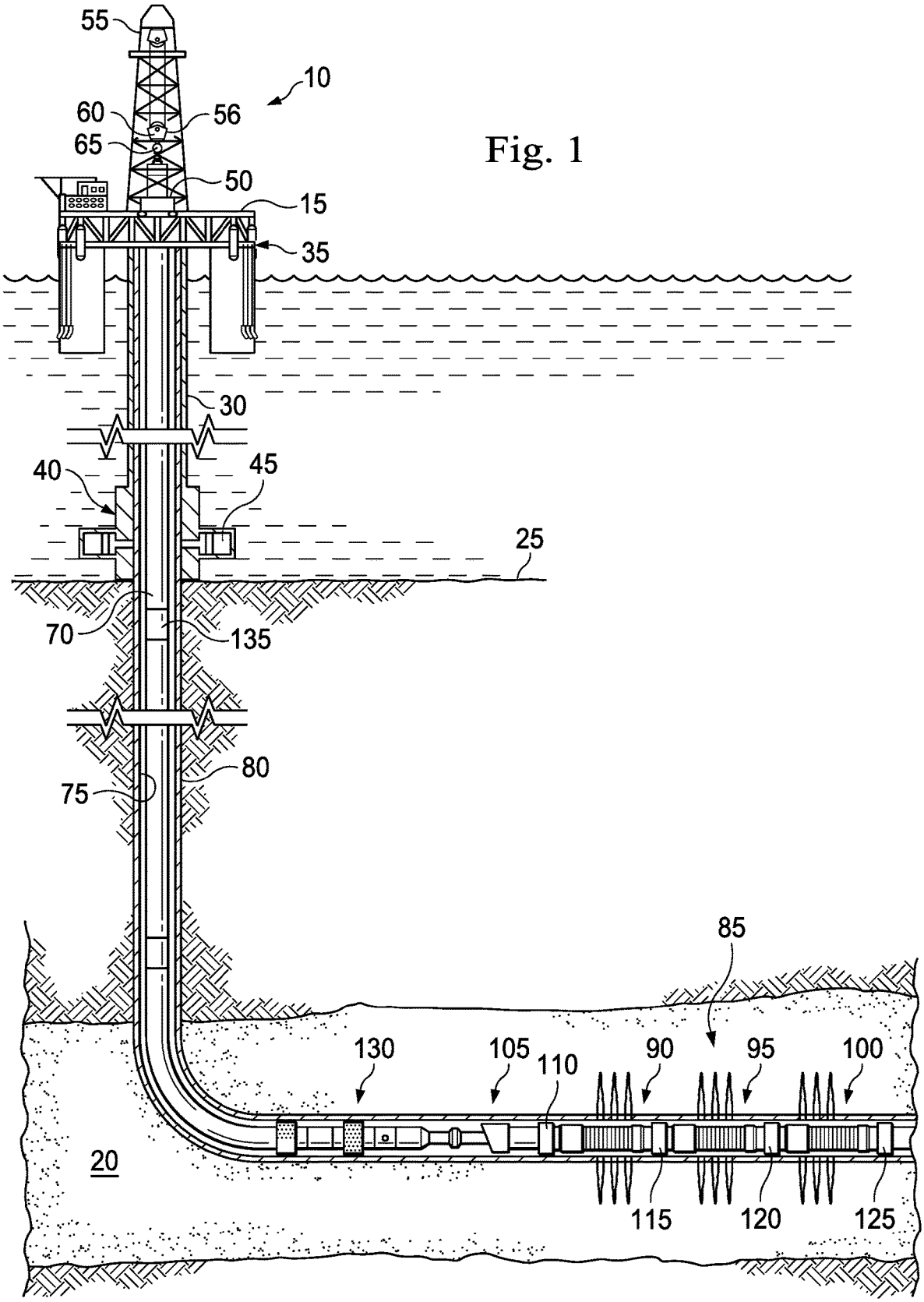
FIG. 1 is a schematic illustration of an offshore oil and gas platform operably coupled to a subsurface flapper valve assembly according to an embodiment of the present disclosure.

Referring initially to FIG. 1, an upper completion assembly is installed in a well having a lower completion assembly disposed therein from an offshore oil or gas platform that is schematically illustrated and generally designated 10. However, and in some cases, a single trip completion assembly (i.e., not having separate upper and lower completion assemblies) are installed in the well. A semi-submersible platform 15 is positioned over a submerged oil and gas formation 20 located below a sea floor 25. A subsea conduit 30 extends from a deck 35 of the platform 15 to a subsea wellhead installation 40, including blowout preventers 45. The platform 15 has a hoisting apparatus 50, a derrick 55, a travel block 56, a hook 60, and a swivel 65 for raising and lowering pipe strings, such as a substantially tubular, axially extending tubing 70.

A wellbore 75 extends through the various earth strata including the formation 20 and has a casing string 80 cemented therein. Disposed in a substantially horizontal portion of the wellbore 75 is a lower completion assembly 85 that includes at least one screen assembly, such as screen assembly 90 or screen assembly 95 or screen assembly 100, and may include various other components, such as a latch subassembly 105, a packer 110, a packer 115, a packer 120, and a packer 125.

Disposed in the wellbore 75 is an upper completion assembly 130 that couples to the latch subassembly 105 to place the upper completion assembly 130 and the tubing 70 in communication with the lower completion assembly 85. In some embodiments, the latch subassembly 105 is omitted.

A subsurface safety valve assembly 135, which includes a flapper valve plate and a spring, is located within the production tubing 70 or is in series with the production tubing 70. The safety valve assembly 135 closes to seal the wellhead 40 from the well formation 20 in the event of abnormal conditions. Generally, during production from the well formation 20, the flapper valve plate is maintained in the valve open position by hydraulic control pressure received from a surface control system through a control conduit or a variety of other mechanisms.

Figure 2:
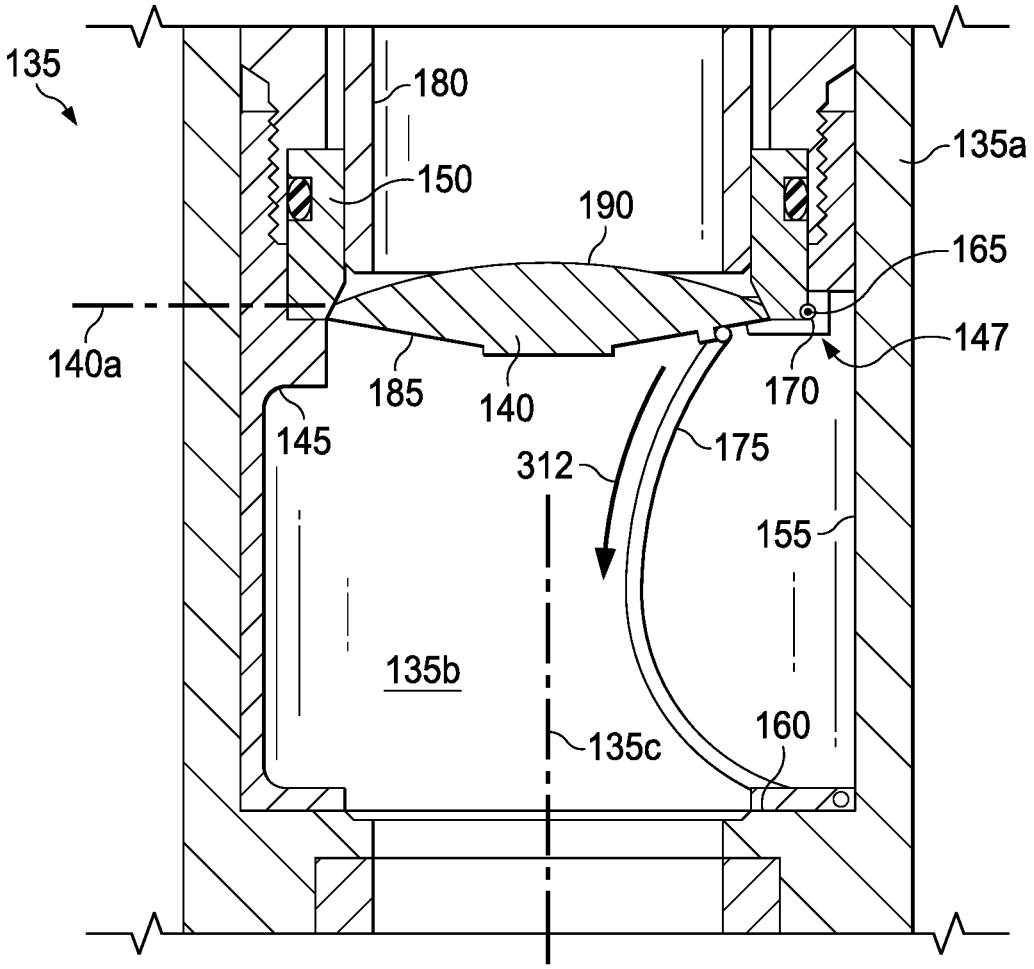
FIG. 2 is a half sectional view of the subsurface flapper valve of FIG. 1 in the valve closed position, according to an example embodiment of the present disclosure.
Figure 3:
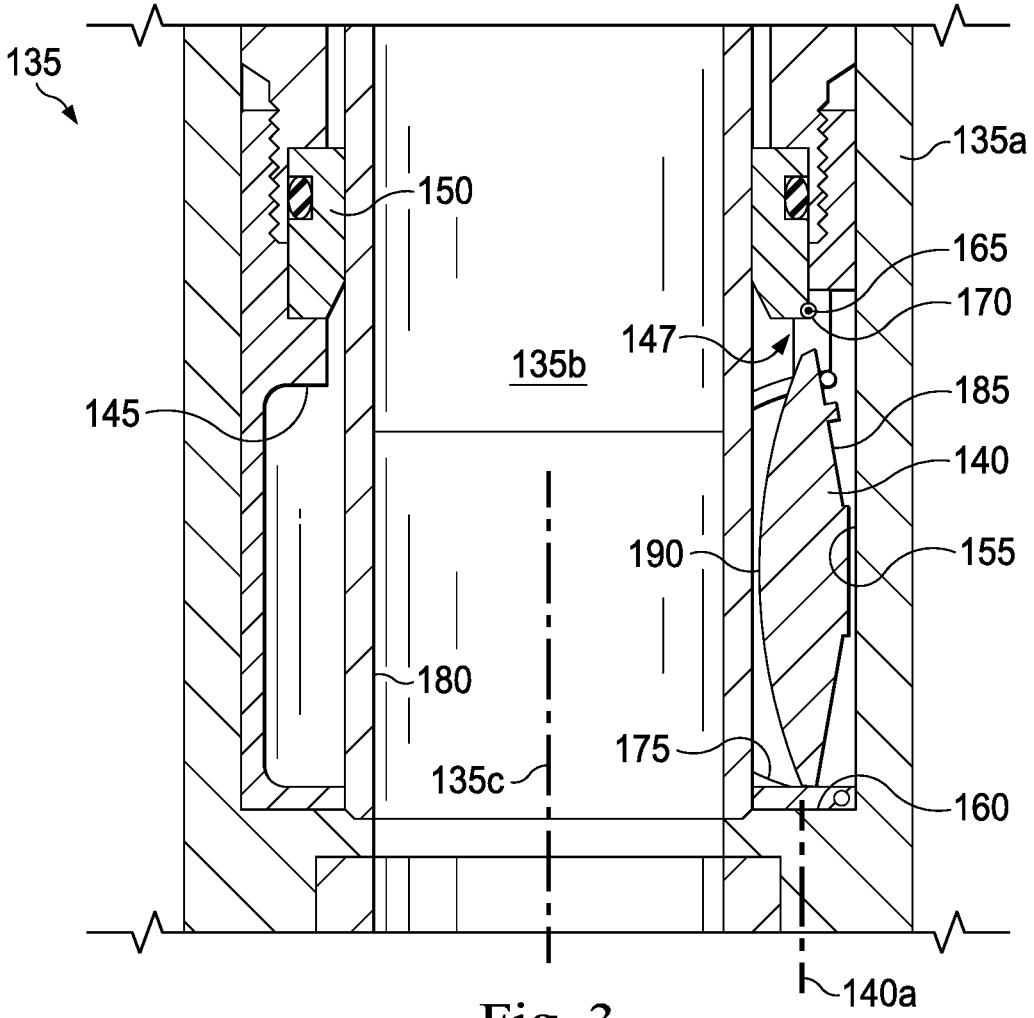
FIG. 3 is a half sectional view of the subsurface flapper valve of FIG. 1 in the valve open position, the subsurface flapper valve including a spring, according to an example embodiment of the present disclosure.

Referring now to FIGS. 2 and 3, one example of the subsurface safety valve assembly 135 is illustrated. In one or more example embodiments, a safety valve housing 135*a* is connected directly in series with the production tubing 70 so that a passage 135*b*, which is formed by the housing 135*a*, is in fluid communication with a passageway within the tubing 70.

In one or more example embodiments, a flapper plate 140 is pivotally mounted onto a hinge sub 145 via a hinge assembly 147, with the hinge sub 145 being fixedly coupled relative to the housing 135*a*. In one or more example embodiments, a valve seat 150 is confined within a counterbore formed on the hinge sub 145 or at least in part by the hinge sub 145. In one or more example embodiments, the valve seat 150 forms a portion of the passage 135*b*. Generally, the flapper plate 140 is positioned to move within a flapper chamber 155 between an open position and a closed position. In some embodiments, the flapper chamber 155 is formed within the passage 135*b* and along a longitudinal axis 135*c* of the housing 135*a* between the valve seat 150 and an internal shoulder 160 spaced from the valve seat 150. While the flapper plate 140 is illustrated as pivotally mounted onto the hinge sub 145, there are multiple configurations, as illustrated herein, for pivotally mounting the flapper plate 140 relative to the valve seat 150. For example, and in some embodiments, the hinge sub 145 is integrally formed with the housing 135*a* and thus the plate 140 is mounted to the housing 135*a*. In some embodiments, the hinge sub 145 is a valve housing and forms the flapper chamber 155. Regardless, the flapper plate 140 pivots about a pivot axis or pivot point 165 via a pin 170 that extends through the flapper plate 140 and a portion of the hinge sub 145. The flapper plate 140 is biased to the valve closed position as shown in FIG. 2 by a spring 175. In the valve open position as shown FIG. 3, the spring bias force is overcome and the flapper plate 140 is retained in the valve open position by an operator tube 180 or other object to permit formation fluid flow up through the passage 135*b* and the tubing 70.

Figure 4:
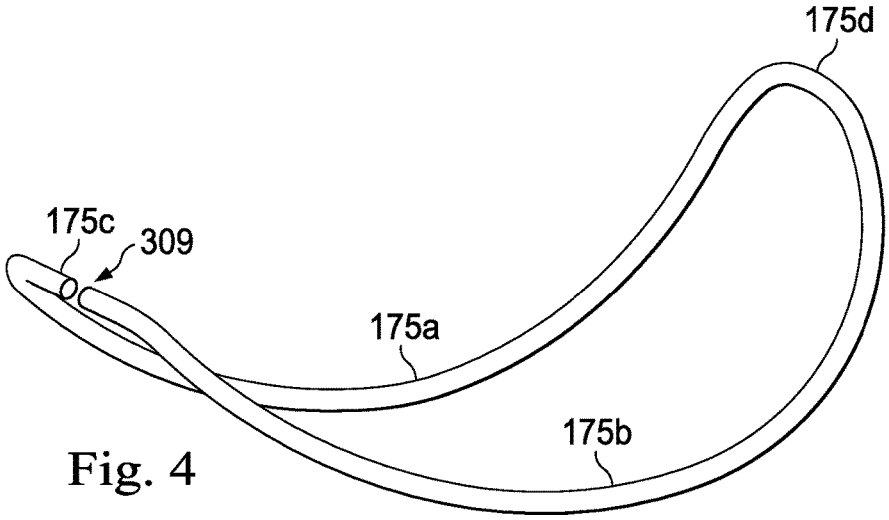
FIG. 4 is a perspective view of the spring of FIG. 3, according to an embodiment of the present disclosure.
Figure 5:
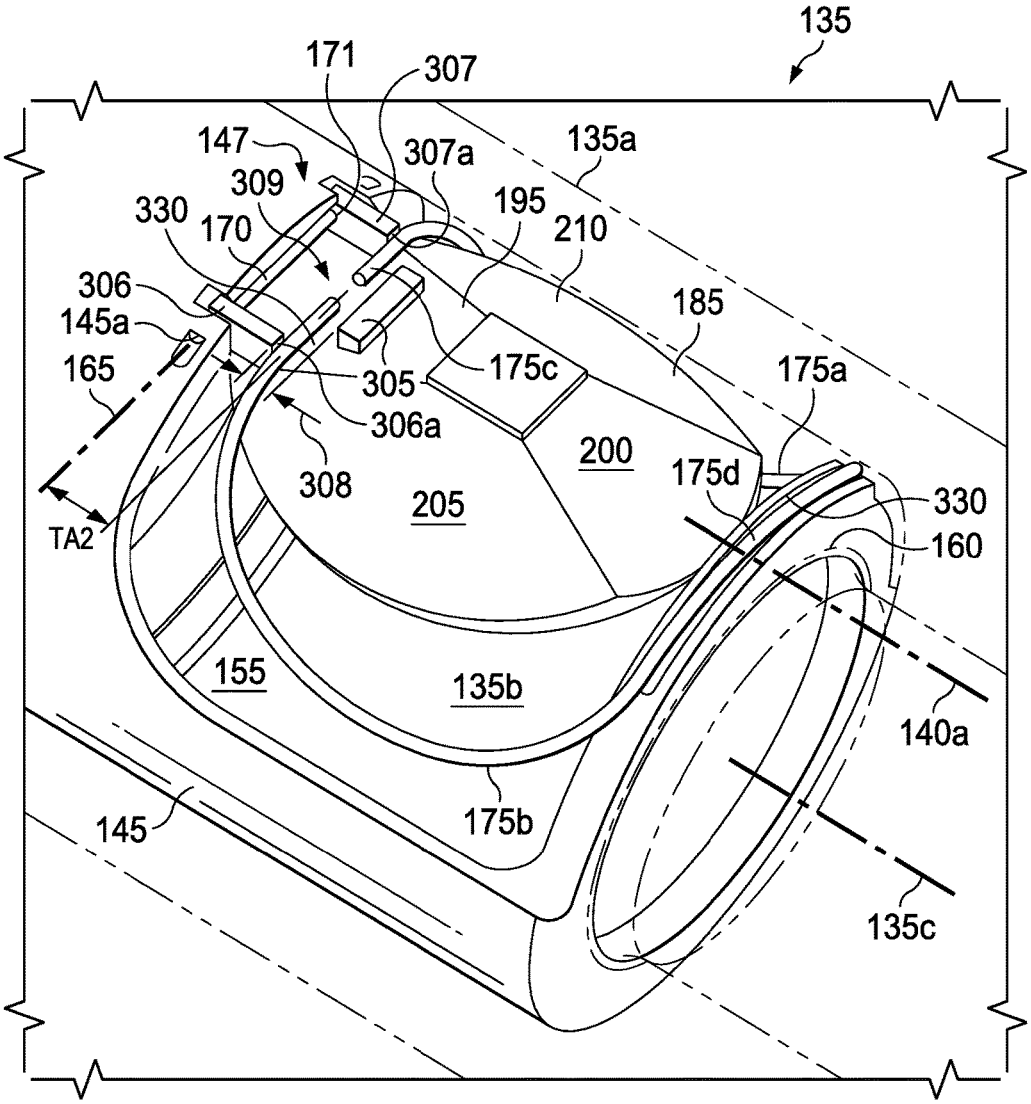
FIG. 5 is a perspective view of a portion of the subsurface flapper valve of FIG. 1 in the valve open position.
Figure 6:
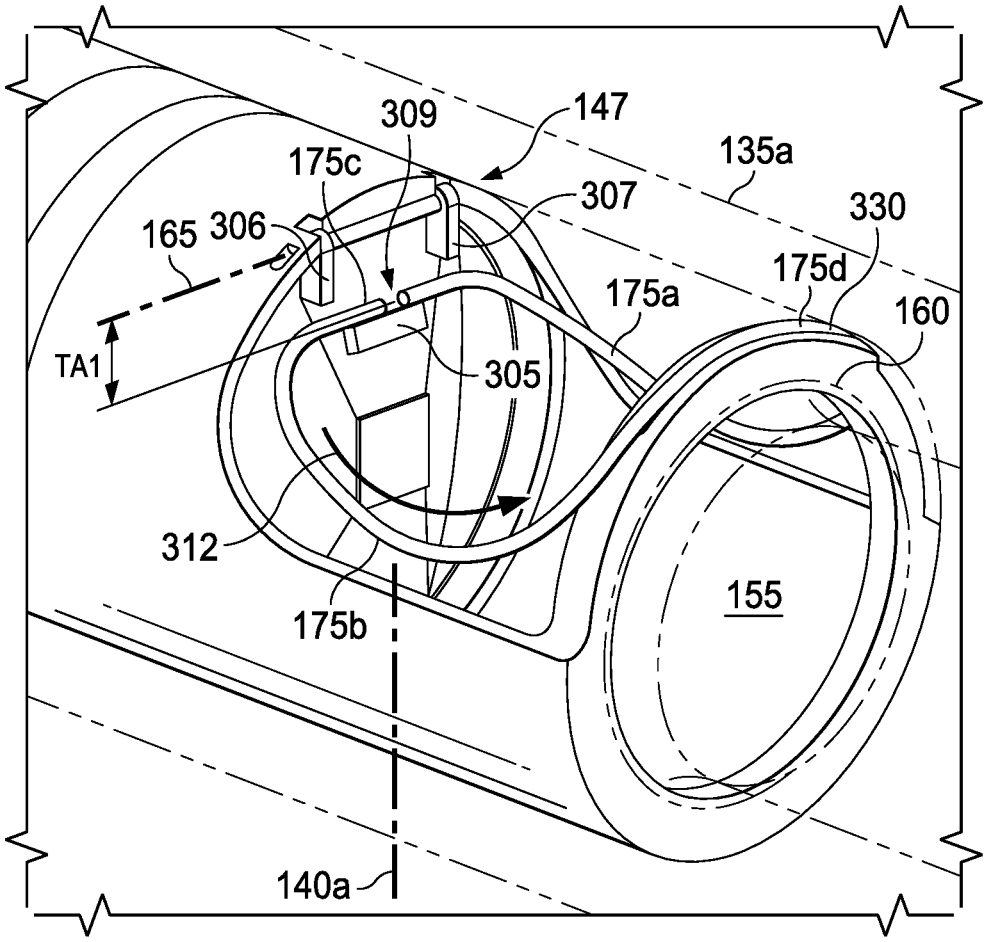
FIG. 6 is a perspective view of the portion of the subsurface flapper valve of FIG. 5 in the valve closed position, according to an example embodiment of the present disclosure.

In some embodiments and as illustrated in FIG. 4, the spring 175 includes first and second opposing arms 175*a* and 175*b* configured to extend within the chamber 155. In some embodiments, the first and second opposing arms 175*a*, 175*b* are spaced and connected via a first bridge portion 175*c* and/or a second bridge portion 175*d*. As illustrated, a space 309 or gap is present in the bridge portion 175*c* such that the arms 175*a* and 175*b* extend toward one another in the bridge portion 175*c* but are not connected. While the space 309 is located within the bridge portion 175*c*, it could alternatively be located in the bridge portion 175*d*. In some embodiments, the spring 175 forms a loop shape with a small gap or a c-shape. Generally, and as illustrated in FIGS. 5 and 6, the plate 140 has an upper surface 185 and an opposing bottom surface 190 (illustrated in FIGS. 2 and 3). Circumferentially, the upper surface 185 of the plate 140 defines a top portion 195 and an opposing bottom portion 200. A left portion 205 and an opposing right portion 210 extend between the top and bottom portions 195 and 200. In some embodiments, a protrusion or stop 305 is coupled to, or formed by, the top portion 195 of the upper surface 185. In some embodiments, supports 306 and 307 couple the plate 140 to the housing 135*a* via the pin 170 and form shoulders 306*a* and 307*a* relative to the upper surface 185. In some embodiments, the supports 306 and 307 are integrally formed in the plate 140. A spacing 308 along a longitudinal axis 140*a* of the plate 140 is formed between each of the shoulders 306*a*, 307*a* and the protrusion 305. Generally, the pin 170, a bore 145*a* through the hinge sub 145 in which the pin 170 extends, and a bore 171 through the flapper plate 140 through which the pin 170 extends form the hinge assembly 147.

In some embodiments, the bridge portion 175*c* is accommodated in the spacing 308. In some embodiments, an outwardly-facing groove 330 is formed in the sub 145 and sized to accommodate the bridge portion 175*d* of the spring 175. When the bridge portion 175*d* of the spring 175 is accommodated in the groove 330, the bridge portion 175*d* of the spring 175 is fixed relative to the sub 145 (fixed along the axis 135*c* of the housing 135*a* and generally fixed rotationally relative to the groove 330) while the bridge portion 175*c* is longitudinally movable along the axes 135*c* and 140*a* and movable rotationally relative to the plate 140 within the spacing 308.

Figure 7:
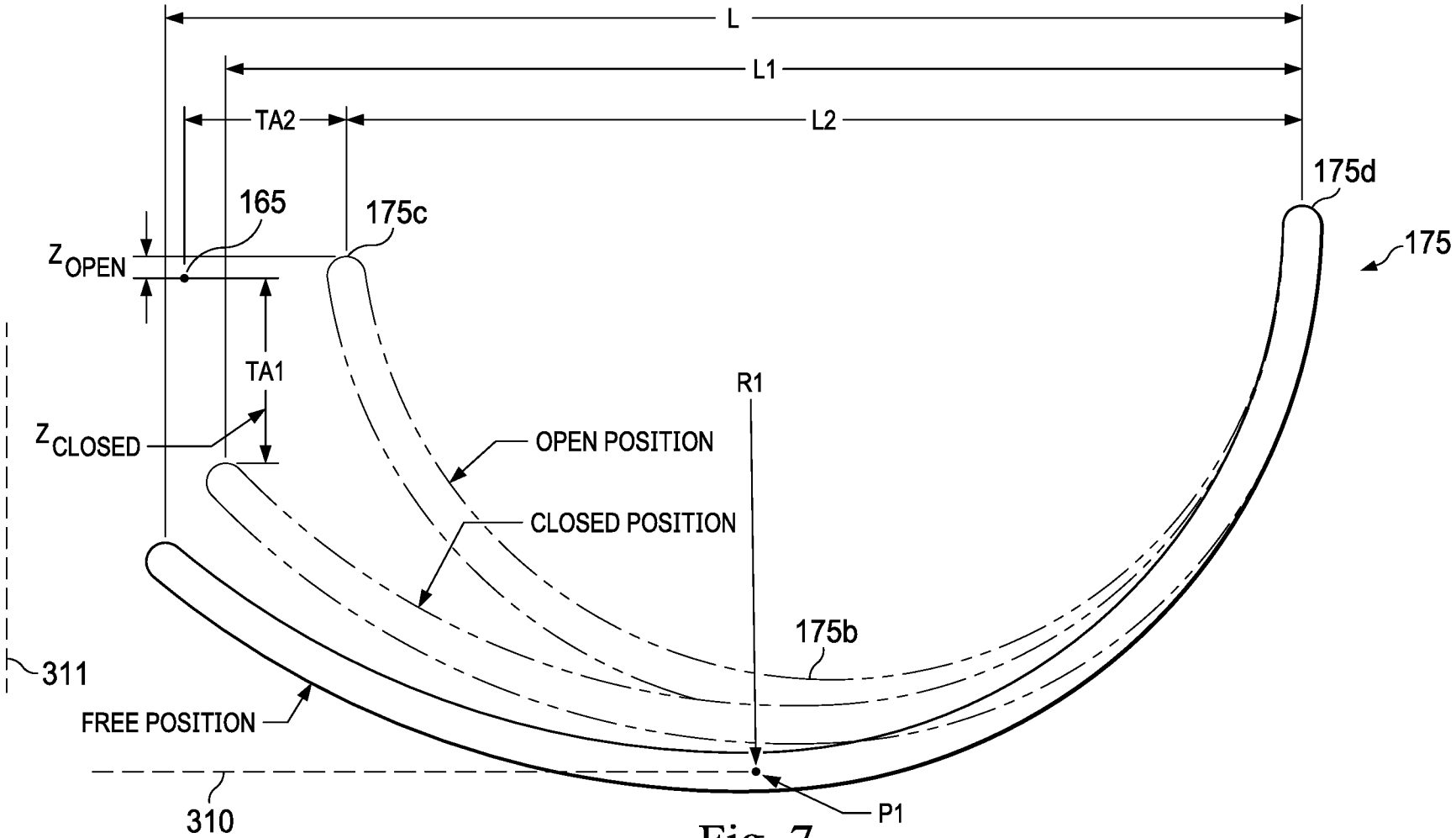
FIG. 7 is a side view of the spring of FIG. 3 in different positions, according to an embodiment of the present disclosure.

During operation and as illustrated in FIG. 7, the spring 175 cycles through different positions. In some embodiments, each of the arms 175*a* and 175*b* has an arched shape or curved shape with a first radius of curvature R1 at a point P1 (on the arms 175*a* and 175*b*) when the spring 175 is not loaded or when it is in a free position or state. When in the free state, the spring 175 has a length L measured along an axis 310. When the plate 140 is in a closed position or when the spring 175 is in a pre-set state, each of the arms 175*a* and 175*b* has a more severely arched shape or a curved shape with a second radius of curvature that is smaller than the first radius of curvature. Moreover, the spring 175 has a length L1 when the flapper plate 140 is in the closed position. Generally, L1 is less than L to energize the spring 175 and bias the plate 140 to a closed position. As illustrated, when in the closed position, the bridge portion 175*c* is spaced from the pivot point 165 by distance TA1, which corresponds with a torque arm distance and is measured along an axis 311 and in a radial direction. Generally, the axis 311 corresponds with the axis 140*a* when the plate 140 is in the closed position and the axis 310 is parallel or substantially parallel to the axis 140*a* when the plate 140 is in the open position. Torque is applied to the plate 140 at a point that is spaced from the pivot point 165 by a distance Zclosed measured along the axis 311. That is, a first lever arm is defined by TA1 and the angle of plate 140 relative to the axis 310 and/or 135*c*. Generally, the compressional force of the spring 175 when the flapper plate 140 is in the closed position is based on the TA1 and the Zclosed distance, among other factors. Generally, increasing the distance Zclosed and/or TA1 increases the torque applied to the plate 140 when the plate 140 is closed. When the plate 140 is in an open position, each of the arms 175*a* and 175*b* has a very severely arched shape or a curved shape with a third radius of curvature that is smaller than the first and second radii of curvature. Thus, the spring 175 has a dual arch with a curved geometry. The spring 175 has a length L2 when the plate 140 is in the open position. Generally, L2 is less than L and L1 to energize the spring 175 and bias the plate 140 to a closed position. Moreover, and as illustrated, when in the open position, the bridge portion 175*c* is spaced from the pivot point 165 by distance TA2, which corresponds with a torque arm distance and is measured along the axis 310. Torque is applied to the plate 140 at a point that is spaced from the pivot point 165 by a distance Zopen measured along the axis 311. A second lever arm is defined by TA2 and the angle of the plate 140 relative to the axis 310 and/or the axis 135*c*. Generally, the second lever arm is less than the first lever arm. Generally, the compressional force of the spring 175 when the flapper plate 140 is in the open position is based on the TA2 and the Zopen distance, among other factors. As illustrated, Zclosed is measured in one direction from the pivot point 165 while the Zopen is measured in an opposite direction from the pivot point 165. However, in some embodiments, Zopen and Zclosed are measured in one direction. In some embodiments, each of the bridge portions 175*c* and 175 is considered an end portion of the spring 175. In some embodiments, TA1 is greater than TA2. In some embodiments, TA1 is greater than TA2 by a distance that is equivalent to, or at least based on, the spacing 308.

When the plate 140 is in the closed position and as illustrated in FIGS. 2 and 6, the axis 140*a* of the plate 140 is generally perpendicular to the axis 135*c* of the housing 135*a* and the surfaces 185 and 190 block the passage 135*b*. The bridge portion 175*c* contacts the protrusion 305 or at least is spaced from the shoulders 306*a* and 307*a*. The movement of the bridge portion 175*c* towards the protrusion 305 and away from the shoulders 306*a* and 307*a* when in the closed position increases the torque arm TA2 to torque arm TA1 and thus the torque applied to the flapper plate 140. When moving between the closed and open positions and the corresponding torque arms TA1 and TA2, the bridge portion 175*c* slides across the upper surface 185 of the flapper plate 140. Moreover, and when in the closed position, the bridge portion 175*c* contacts the plate 140 while the arms 175*a* and 175*b* extend away from the flapper plate 140 and toward the internal shoulder 160. As illustrated, the arms 175*a* and 175*b* extend away from the plate 140 in a direction illustrated in an arrow 312. That is, the arms 175*a* and 175*b* are not flush against the upper surface 185 of the flapper plate 140 when the plate 140 is in the closed position.

As the flapper plate 140 is opened, forces increase in the spring 175 allowing the spring 175 to stress. As such, the arms 175*a* and 175*b* activate, energize, load, or flex and move the bridge portion 175*c* towards and against the shoulders 306*a* and 307*a*, which shifts the bridge portion 175*c* closer to the pivot point 165 (from TA1 to TA2), allowing for a new loaded configuration. As the bridge portion 175*c* slides across the upper surface 185 of the flapper plate 140 to reduce TA1 to TA2, the valve assembly 135 is a variable torque valve. That is, the location along the flapper plate (measured along the axis 140*a*) at which the spring 175 applies load varies between the open and closed position to provide variable torque.

Figure 8:
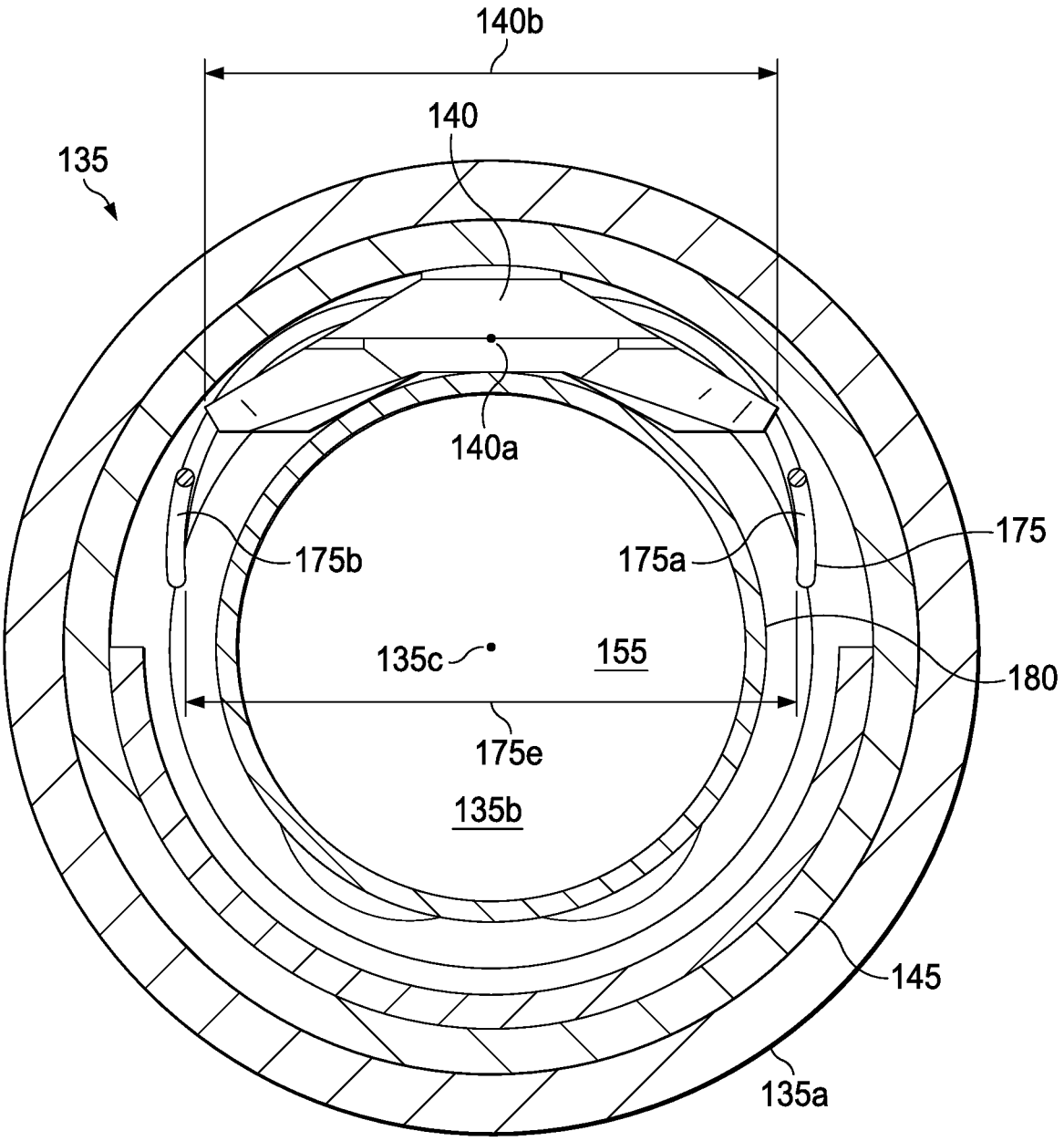
FIG. 8 is a cross-sectional view of the subsurface flapper valve of FIG. 5 in the valve open position, according to an example embodiment of the present disclosure.

When the plate 140 is in the open position and as illustrated in FIGS. 3, 5, and 8, the axis 140*a* of the plate 140 is generally parallel to the axis 135*c* of the housing 135*a* and the passage 135*b* is open. In some embodiments, the upper surface 185 of the plate 140 is in contact with an interior surface of the housing 135*a*. Generally, the bridge portion 175*c* is forced against the shoulders 306*a* and 307*a* while the arms 175*a* and 175*b* are compressed. In this configuration, portions of the arms 175*a* and 175*b* extend beyond the right and left portions 205 and 210 of the plate 140. That is, and as illustrated in FIG. 8, in a cross-sectional view, the spring 175 has a clearance 175*e* that is defined by the arms 175*a*, 175*b* that is greater than a width 140*b* of the plate 140. As viewed, the spring 175 is not concentric with the axis 135*c* but offset from the axis 135*c*. That is, while forming a looped-like or c-shape, the axis 135*c* does not extend within the circumference of the spring 175.

To ensure the flapper plate 140 opens completely, the footprint of the spring 175 when viewed in the cross-section view of FIG. 8, does not contact or interfere with the outer diameter of the operator tube 180 and is in minimal contact with the inner surface of the housing 135*a*. As such and in some embodiments, the portions of the arms 175*a* and 175*b* that flex are not positioned between the upper surface 185 of the plate 140 and the inner surface of the housing 135*a*.

Generally, the spring 175 is composed of a material with a selected Young's Modulus and the arms 175*a*, 175*b* are sized with a cross-section that provides predetermined strength and elastic properties. In some embodiments, the dual arm and the curved geometry of the spring 175 prevents the spring 175 from overstressing when the plate 140 is in the open position. In some embodiments, shortening of the torque arm from TA1 to TA2 reduces the stresses on the spring 175. In some embodiments, Zopen being spaced from the pivot point 165 in a direction opposite from Zclosed reduces the stresses on the spring 175 and/or the plate 140. In some embodiments, the compressional strength of the spring 175 is dependent, almost entirely, from R1 (illustrated in FIG. 7). This energizes the landing position to allow for a pre-set configuration and provides the necessary torque. The cantilever properties are maintained by the dual arms being supported by the fixed end or bridge portion 175*d*, which is trapped between the tangency of the sub 145 and the inner surface of the housing 135*a*.

Figure 9:
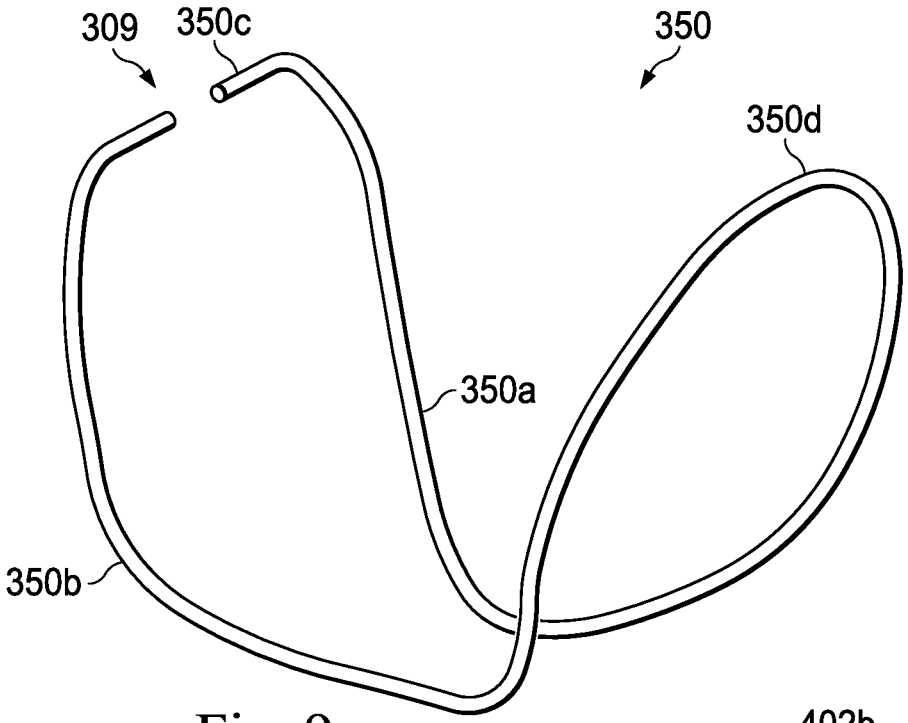
FIG. 9 is another embodiment of the spring of FIG. 4, according to an example embodiment of the present disclosure.
Figure 10B:
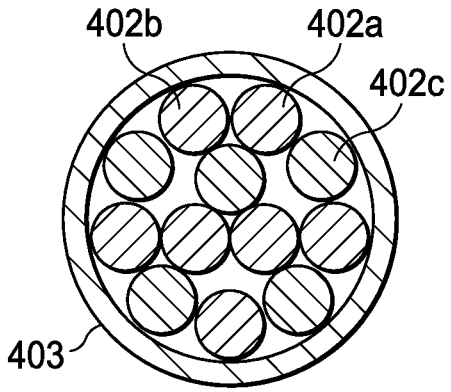
FIG. 10B is a cross-sectional view of the spring of FIG. 10A according to an example embodiment of the present disclosure.
Figure 10A:
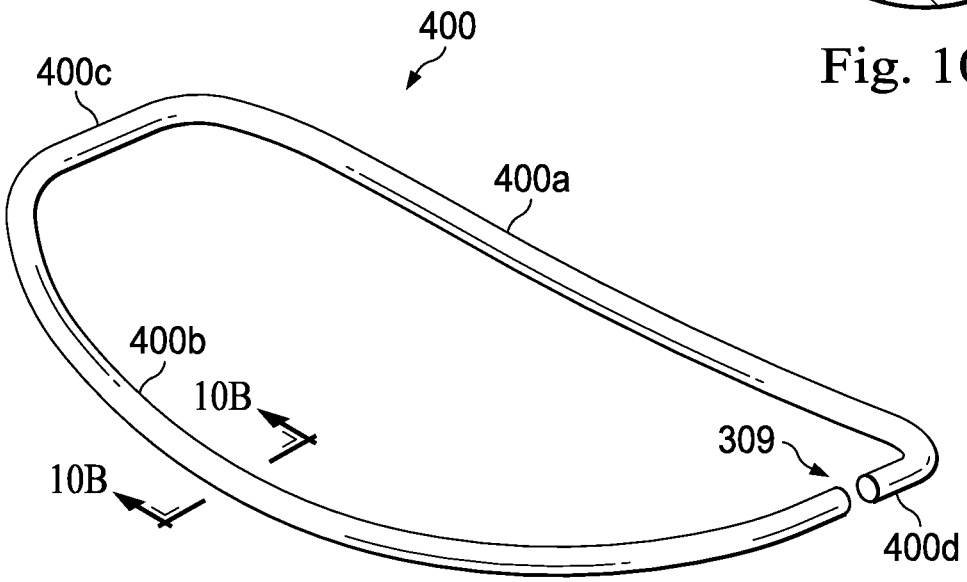
FIG. 10A is a perspective view of another embodiment of the spring of FIG. 4 according to an example embodiment of the present disclosure.
Figure 11A:
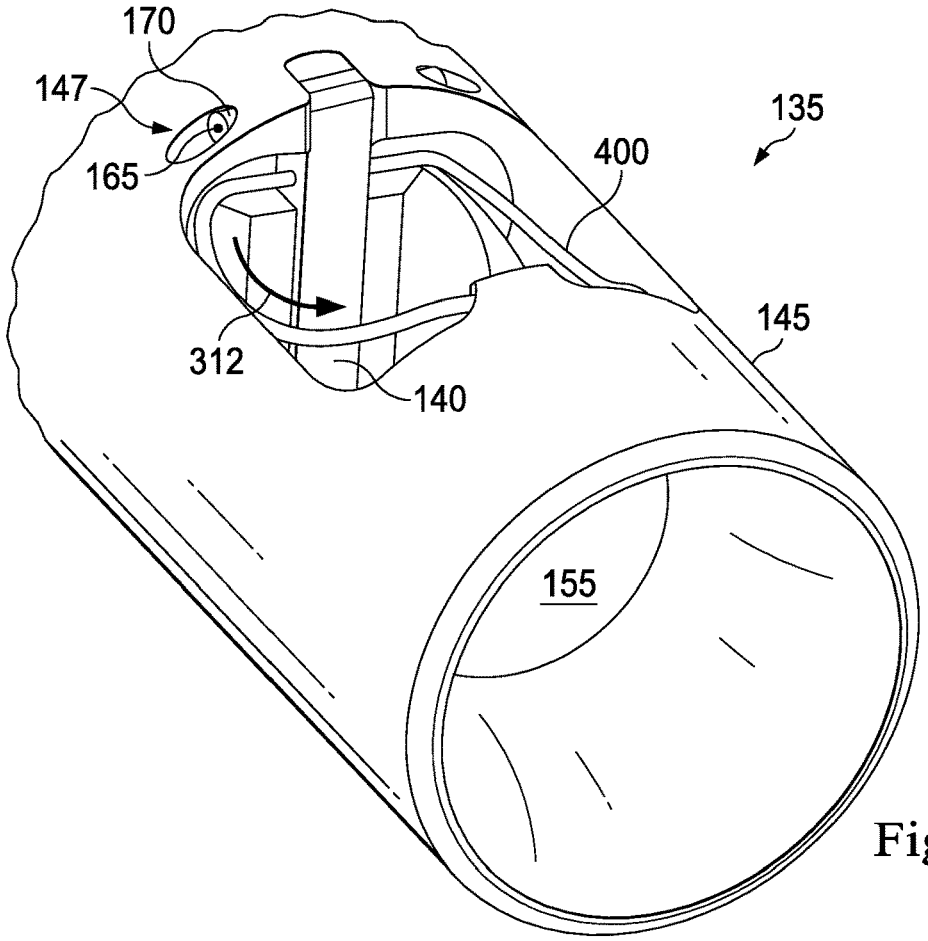
FIG. 11A is a perspective view of a portion of the subsurface flapper valve of FIG. 5 with the spring of FIG. 10A in the valve closed position, according to another embodiment of the present disclosure.
Figure 11B:
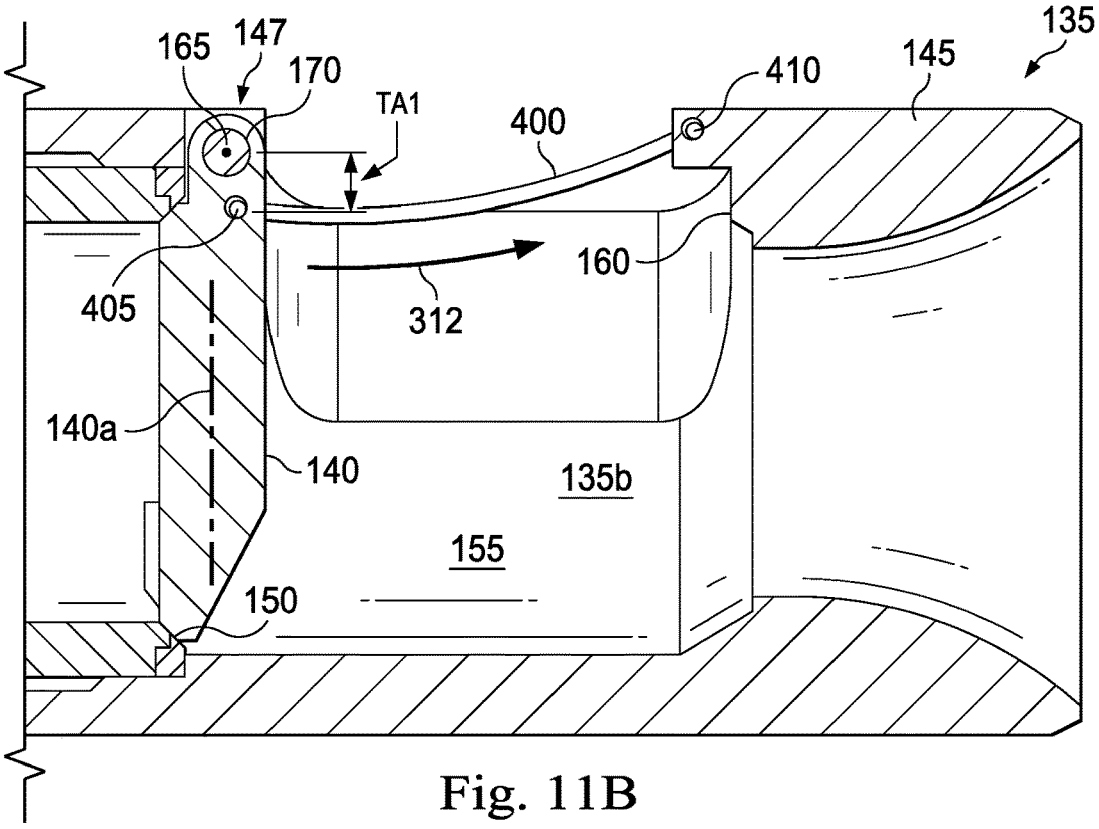
FIG. 11B is a cross-sectional view of the portion of the subsurface flapper valve of FIG. 11A in the valve closed position, according to an example embodiment of the present disclosure.

Another embodiment of the spring 175 is identified by the numeral 350 in FIG. 9. The spring 350 is substantially similar to the spring 175 except the spring 350 forms a saddle-like shape with the arms 350*a* and 350*b* circumferentially extending around a larger portion of the tube 180. Thus, the reference numerals used to refer to the features of the spring 350 that are substantially identical to the features of the spring 175 will correspond to the reference numerals used to refer to the features of the spring 175 except that the prefix for the reference numerals used to refer to the features of the spring 175, that is, 175, will be replaced by the prefix of the spring 350, that is, 350. As illustrated in FIG. 9, the bridge portion 350*c* of the spring 175 includes the spacing or gap 309.

In some embodiments, the springs 175 and 350 reduce or eliminate interference with the performance of a resilient seal positioned near the pin 170 by reducing turbulent flow created by the springs 175 and 350. That is, the springs 175 and 350 allow for the sub 145 to cover the resilient seal (when the resilient seal is positioned between the sub 145 and the passage 135*b*) and offer protection from debris as each of the springs 175 and 350 mounts to the sub 145 at a location at or near the internal shoulder 160, or away from the hinge or pivot point 165. In some embodiments, the mounting of the springs 175 and 350 to the sub 145 at a location at or near the shoulder 160 results in the arms 175*a* and 175*b* extending away from the plate 140 and towards the internal shoulder 160 when the plate 140 is in the open or closed position. In some embodiments, the springs 175 and 350 do not require significant removal of material from the plate 140, thus allowing for a stronger plate 140, which is desirable in the design of high pressure flappers when compared to very thin flappers. In some embodiments, the valve assembly 135 is considered "sand resistant" or more "sand resistant" compared to conventional valve assemblies. That is, sand build-up does not result in flapper closure failure. In some embodiments, the springs 175 and 350 work well during slam closures. In some embodiments, the springs 175 and 350 are compatible with relatively large spring wire. For example, arms 175*a* and 175*b* with a ¼" diameter compare favorably to the 0.05"–0.09" wire used with torsion springs. In some embodiments, the springs 175 and 350 do not require removal of hinge material, which allows for a strong hinge. Thus, the hinge material and pin size can be optimized independently of the closure mechanism (e.g., the pin 170 and flapper hinge can be thickened). In some embodiments, the springs 175 and 350 offer reliable torque at different positions of the plate 140. In some embodiments, the springs 175 and 350 have different landing positions on the flapper plate 140 during the pre-set and loaded configurations. In some embodiments, the springs 175 and 350 generate low stresses in both the fully open and the closed position due to the geometry of the arched arms 175*a*, 175*b* and the relatively small deflection.

Figure 12A:
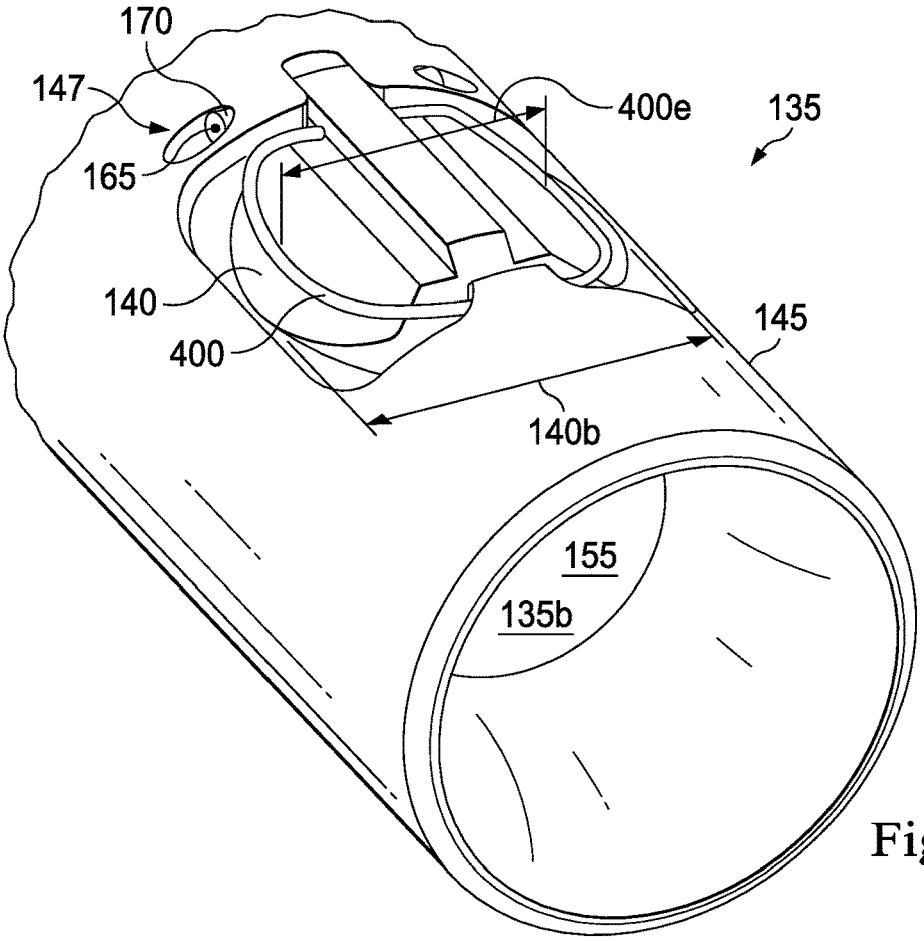
FIG. 12A is a perspective view of a portion of the subsurface flapper valve of FIGS. 11A and 11B in the valve open position, according to an example embodiment of the present disclosure.
Figure 12B:
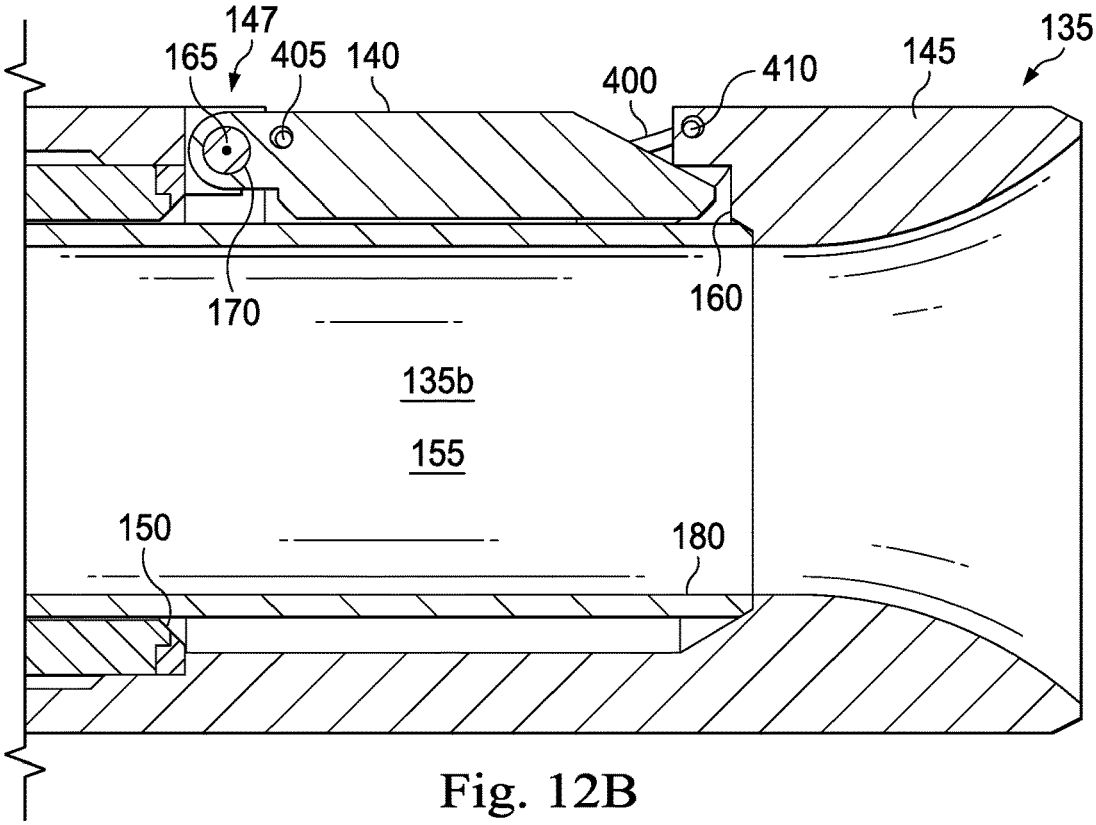
FIG. 12B is a cross-sectional view of the portion of the subsurface flapper valve of FIGS. 11A and 11B in the valve open position, according to an example embodiment of the present disclosure.
Figure 13:
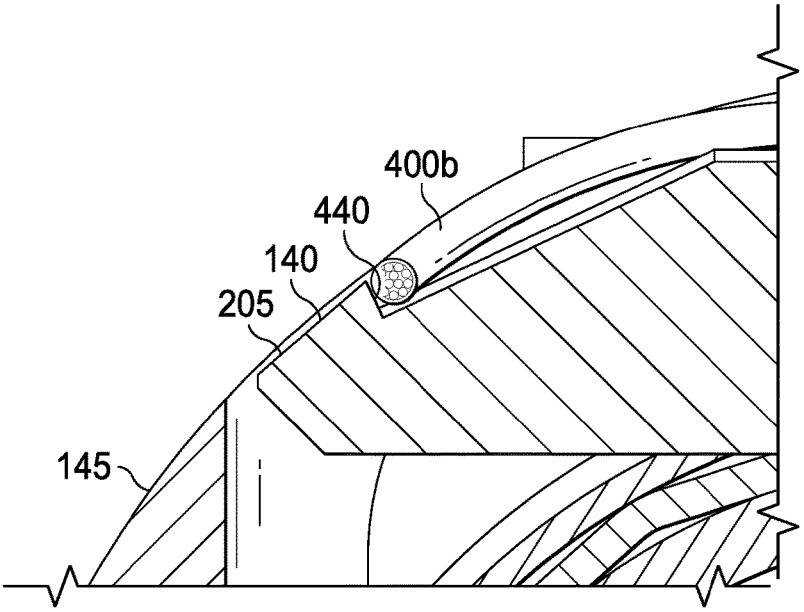
FIG. 13 is a cross-sectional view of a portion of the valve of FIGS. 11A and 11B in the valve open position, according to an example embodiment of the present disclosure.

Another embodiment of the spring 175 is identified by the reference numeral 400 illustrated in FIGS. 10A, 10B, 11A, 11B, 12A, 12B, and 13 (housing 135*a* not shown). The spring 400 appears substantially identical to the spring 175. Reference numerals used to refer to the features of the spring 400 that are substantially identical to the features of the spring 175 will correspond to the reference numerals used to refer to the features of the spring 175 except that the prefix for the reference numerals used to refer to the features of the spring 175, that is, 175, will be replaced by the prefix of the spring 400, that is, 400. In one embodiment, each of the arms 400*a*, 400*b* and bridge portions 400*c*, 400*d* are formed from a plurality of springs 402*a*, 402*b*, 402*c*, etc. surrounded by a sheath 403. As illustrated, the bridge portion 400*c* of the spring 400 is pinned to the plate 140. Generally, being pinned indicates that the bridge portion 400*c* does not translate more than a distance equal to the diameter of a cross-section of the bridge portion 400*c* but is free to rotate about its axis. Here, the bridge portion 400*c* is pinned relative to the axis 140*a* of the flapper plate 140 and rotates relative to a pivot point 405. The bridge portion 400*d* is also pinned relative to the sub 145 via a pivot point 410. Here, the torque arm distance is not variable (e.g., TA1 equals TA2), as the bridge portion 400*c* is pinned relative to the axis 140*a* of the flapper plate 140. Generally, the force required to achieve a specific torque can be optimized by increasing the distance TA1. In one embodiment, the compressional strength of the spring 400 is based on the arms 400*a* and 400*b*. Thus, the arms 400*a* and 400*b* are energized in the pre-set or closed position to provide the necessary compressional forces to keep the plate 140 in the closed position. One difference between the spring 175 and the spring 400 and as illustrated in FIG. 12A is that the clearance 400*e* of the spring 400 is not greater than the width 140*b* of the plate 140 and the arms 400*a* and 400*b* contact and extend along the left and right portion 205 and 210 of the plate 140. Thus, the entirety of the arms 400*a* and 400*b* extend between the plate 140 and the inner surface of the housing 135*a*. As the flapper opens, compression forces on the arms 400*a* and 400*b* increase, forcing the arms 400*a* and 400*b* to stress. As the spring 400 is fully compressed and as illustrated in FIG. 13, the arms 400*a* and 400*b* will resist the movement of the plate 140 to the open position by providing a radially-inward force against the left and right sides 205 and 210 of the plate 140. The forces on the left and right sides 205 and 210 are in addition to the radially-inwardly forces acting on the plate 140 via the bridge portion 400*c*. In some embodiments, the arm 400*b* of the spring 400 rests in a groove 440 formed in the left side 205 of the plate 140 when the flapper is in the open position. A similar groove is formed in the right side 210.

When using the spring 400, compressional forces acting on the flapper plate 140 are positioned away from the flapper pin 170. Moreover, the arms 400*a* and 400*b* assist in closing the flapper plate 140 via the radially-inward force applied to the left and right sides 205 and 210. In some embodiments, the radially-inward force applied to the left and right sides 205 and 210 are via the groove 440 and the opposing groove on the right side 210. Generally, the spring 400 generates low stresses in both the fully open and the closed position, due to the geometry of the arms 400*a* and 400*b* and the relatively short deflection when positioned close to the pivot point 165. Generally, the compressional loads are force driven using the spring 400, therefore the valve seat 150 can be situated anywhere in relation to the pivot point 165. In some embodiments, the use of the plurality of springs 402*a*, 402*b*, 402*c*, etc. allows for the spring 400 to have a higher deflection while maintaining a big cross-sectional area defined by the sheath 403 and high strength. Moreover, in some embodiments, the use of the plurality of springs 402*a*, 402*b*, 402*c*, etc. eliminates or reduces residual stress and deformation.

Figure 14:
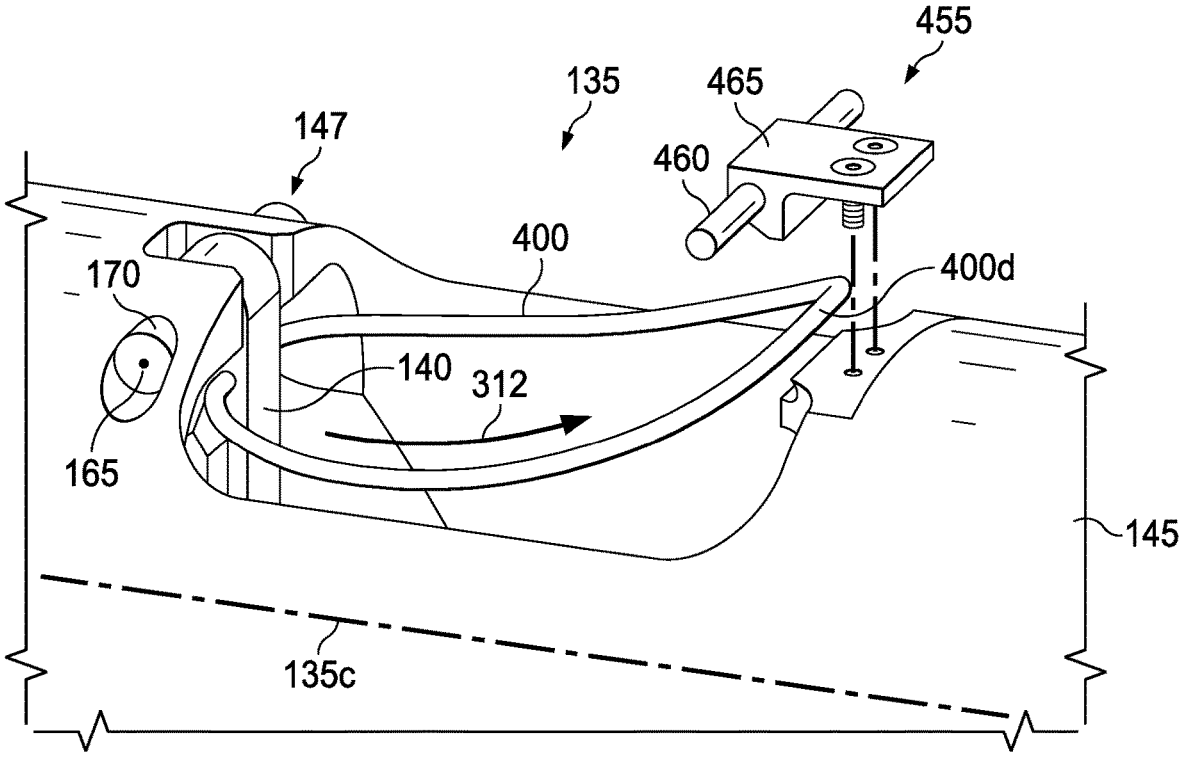
FIG. 14 is a perspective view of a partially exploded view of the valve of FIGS. 11A and 11B in the valve closed position according to another embodiment, wherein the valve includes a fulcrum assembly.
Figure 15:
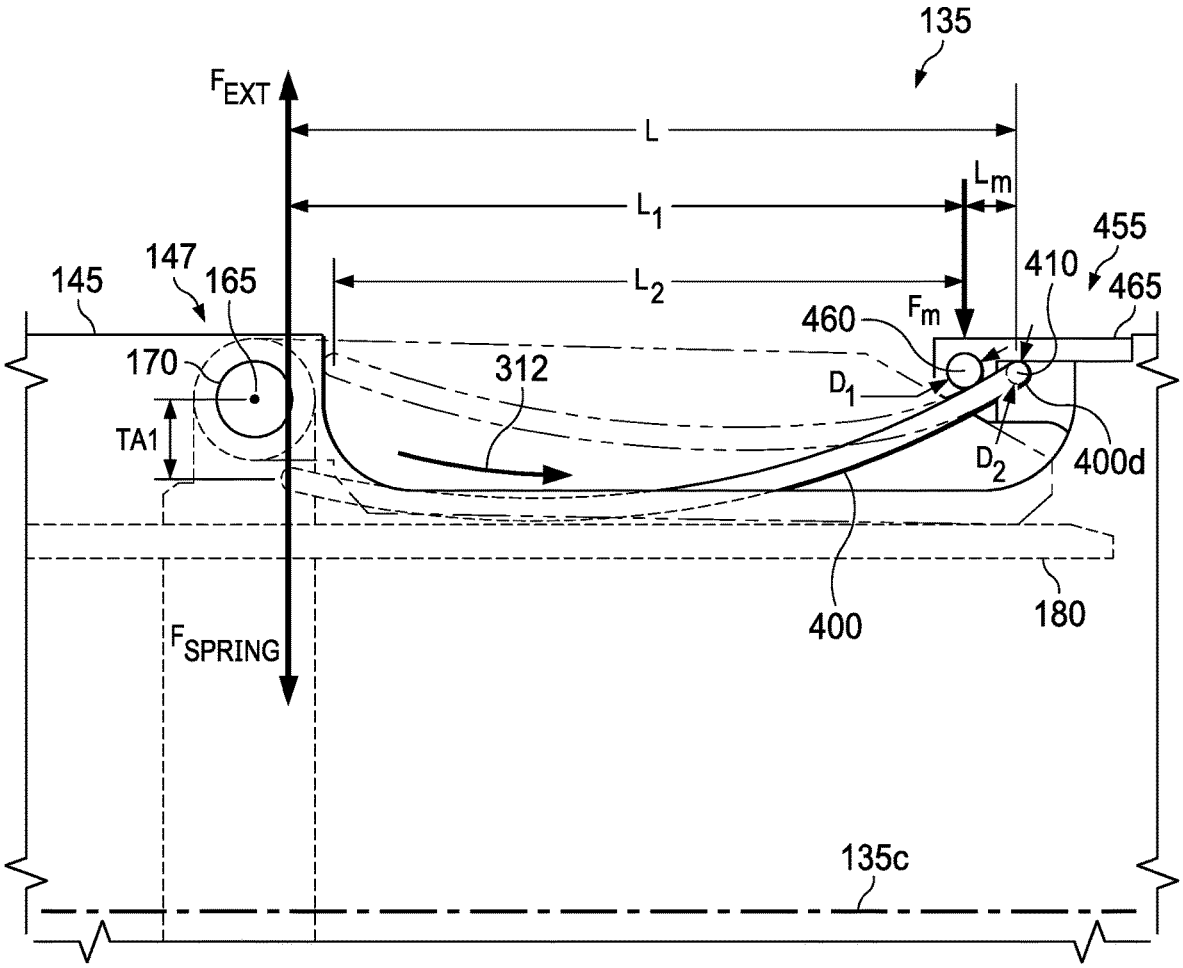
FIG. 15 is a side view of the valve of FIG. 14 in the valve closed position, according to an example embodiment of the present disclosure.

In some embodiments, and as illustrated in FIGS. 14 and 15, the bridge portion 400*d* is pinned to the sub 145 via a fulcrum assembly 455. Generally, the fulcrum assembly includes a pin 460 that extends through a housing 465 in a direction perpendicular to the axis 135*c* and that is spaced from the pivot point 410 by a distance Lm. Generally, the bridge portion 400*d* is pinned between the sub 145 and the fulcrum assembly 455, which is secured to the sub 145 via screws or a similar coupler. Referring to FIG. 15, the spring 400 acts like a Class 1 Lever. When the plate 140 is in the closed position, L1 generates a bending moment arm exerted by $F_{spring}$, which is the compressional force of the spring 400 holding the plate 140 down in the closed position. This is the pre-set position (the spring 400 is compressed to L1 when installed). In this closed configuration, the magnitude of the $F_{spring}$ is dictated by the strength of the spring 400, as it sets the value of the external force $F_{EXT}$ that needs to be produced from the tube 180 reaction to $F_{spring}$ (when the flapper opens). As illustrated in FIG. 15, and when the tube 180 opens the flapper or plate 140, the spring 400 further compresses. The spring moment $F_{spring}$ transfers its compressional load to a new moment $F_m$ $L_m$, supported by the fulcrum load $F_m$. Here L2 generates the bending moment of the external reaction force $F_{EXT}$ provided by the tube 180. $F_{EXT}$ acts on the moment arm $L_1$, which bends the spring 400 through distance L1-L2 (spring's deflection). In some embodiments, minimizing TA1 results in a small deflection. In some embodiments, the cross-section of the arms 400*a* and 400*b* are maximized to produce the high forces necessary to generate a high torque on the flapper or plate 140 (the forces necessary to open and close the plate 140). In some embodiments, the use of the fulcrum 455 allows for a smaller TA1 dimension while creating a $F_{spring}$ adequate to close the flapper plate 140. As illustrated, the pin 460 defines a diameter D1 and the bridge portion 400*d* defines a diameter D2. In some embodiments, the center of D1 is in-line with D2. That is, D1 and D2 are spaced equally (in the radial direction) relative to the axis 135*c*. In those instances, the diameter D1 is larger than D2 to adequate provide a fulcrum for the bridge portion 400*c* relative to the bridge portion 400*d*. As such, the fulcrum assembly 455 generally provides a moment arm for compressional forces within the spring 400.

Figure 16:
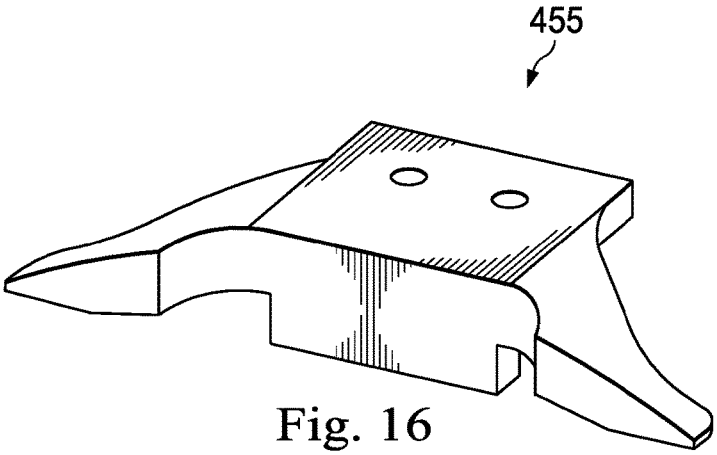
FIG. 16 is perspective view of the fulcrum assembly of FIG. 14, according to another embodiment.

While in some embodiments the pin 460 is distinct from the housing 465, in other embodiments and as illustrated in FIG. 16, the pin 460 and the housing 465 are integrally formed.

Figure 17:
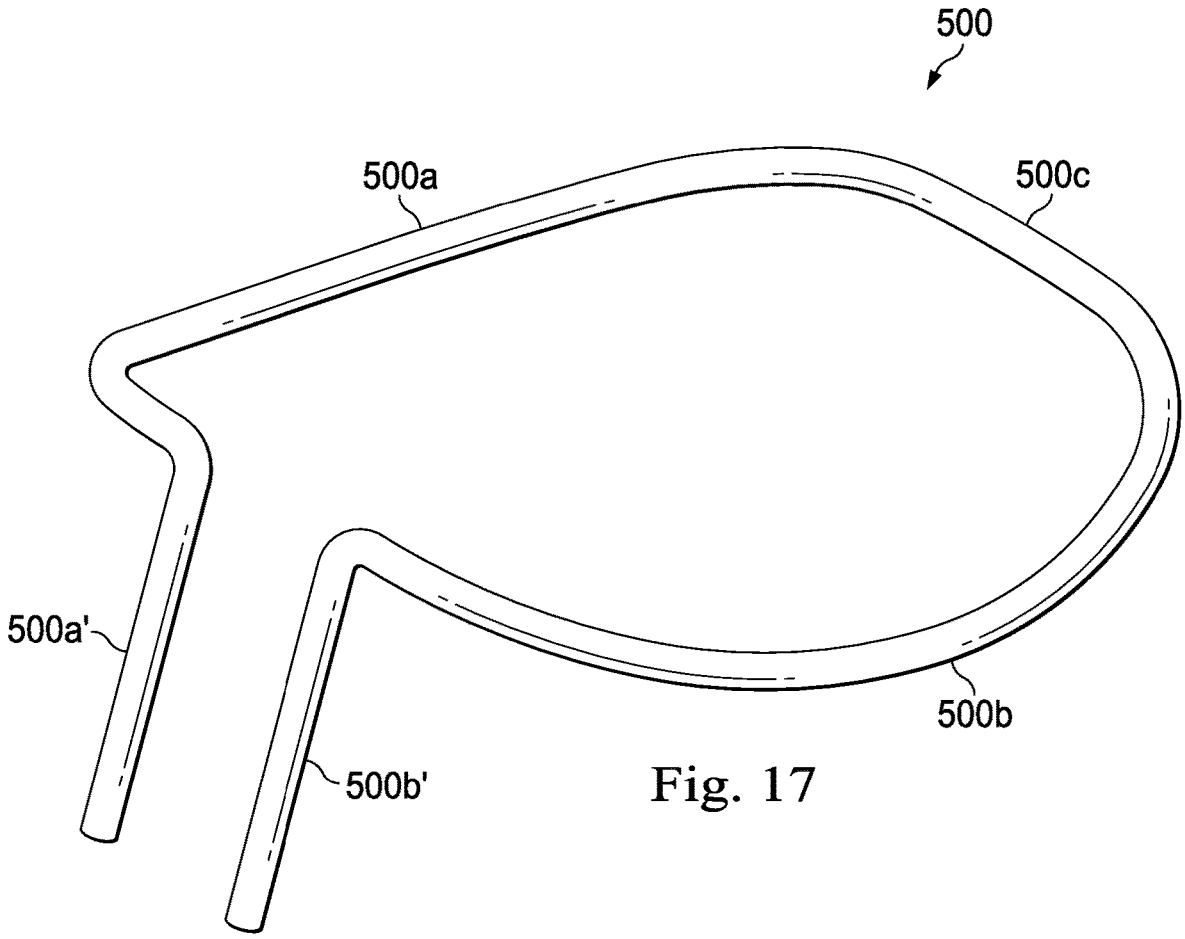
FIG. 17 is a perspective view of another embodiment of the spring of FIG. 4 according to an example embodiment of the present disclosure.
Figure 18:
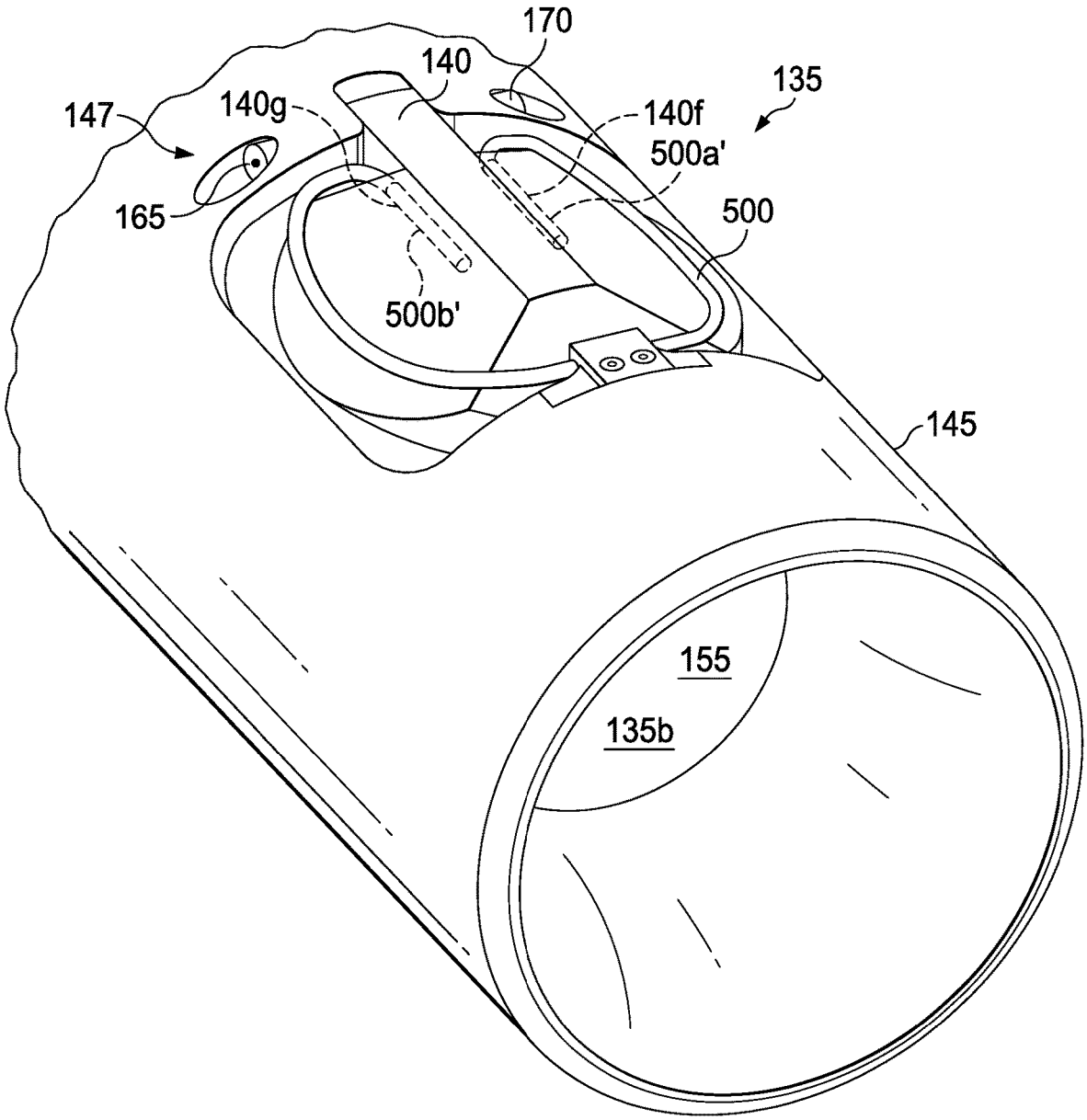
FIG. 18 is a perspective view of a portion of another embodiment of the subsurface flapper valve of FIG. 5 in the valve open position with the spring of FIG. 17, according to an example embodiment of the present disclosure.
Figure 19:
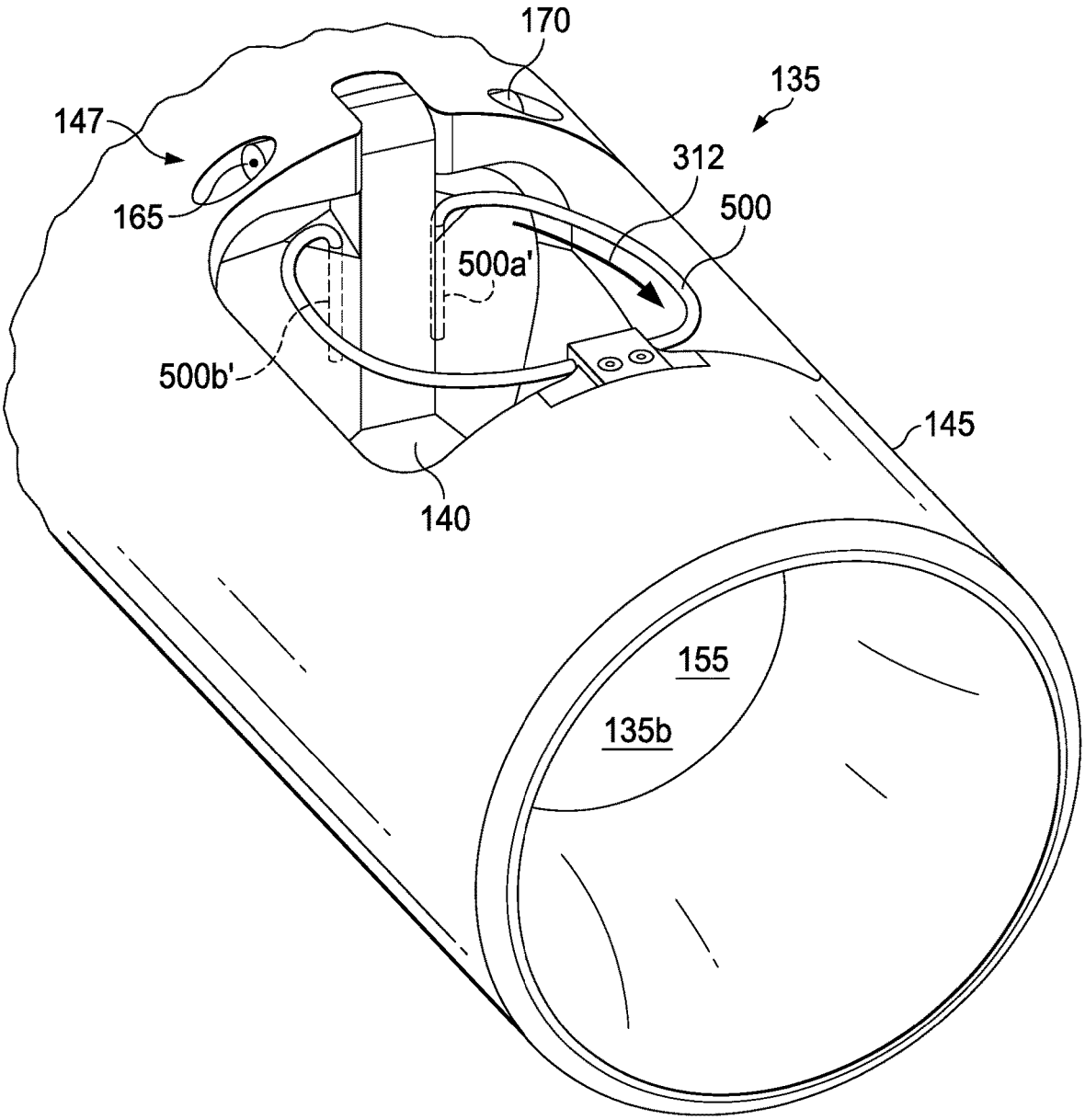
FIG. 19 is a perspective view of the portion of the subsurface flapper valve of FIG. 18 in the valve closed position, according to an example embodiment of the present disclosure.

Another embodiment of the spring 400 is identified by the reference numeral 500 illustrated in FIGS. 17-19. The spring 500 is substantially similar to the spring 400. Reference numerals used to refer to the features of the spring 500 that are substantially similar to the features of the spring 400 will correspond to the reference numerals used to refer to the features of the spring 400 except that the prefix for the reference numerals used to refer to the features of the spring 400, that is, 400, will be replaced by the prefix of the spring 500, that is, 500. In one embodiment, the bridge portion 500*c* is omitted and instead, portions of the arms 500*a* and 500*b*, such as pins 500*a*' and 500*b*', extend within a body of the plate 140. That is, the spring 500 is a dual pin torsion spring. As such, the pins 500*a*' and 500*b*' provide torsional twisting of the spring 500. As illustrated in FIGS. 18 and 19, pockets 140*f* and 140*g* are formed within the plate 140 and are configured to receive the pins 500*a*' and 500*b*', respectively. Screws or other couplers can be attached to the plate to secure the placement of the pins 500*a*' and 500*b*' within the pockets 140*f* and 140*g*. In some embodiments, the bridge portion 500*d* is pinned to the sub 145. In an example embodiment, compressional strength of the arms 500*a* and 500*b* while the flapper plate 140 is in the closed position are sufficient to bias the plate 140 to the closed position. When transitioning from the closed to open position, the pins 500*a*' and 500*b*' twist the arms 500*a* and 500*b*, respectively, to energize the spring 500 further and in addition to the reduction to the length of the spring 500. The twisting of the arms 500*a* and 500*b* serve as the primary load and the compression of the arms 500*a* and 500*b* serve as a secondary load. In some embodiments, the torsional and compressional forces applied to the spring 500 due to the geometry and position relative to the sub 145 and plate 140 biases the plate 140 to the closed position.

Generally, the spring 500 does not extend between the hinge that is created by the pin 170, the sub 145, and the plate 140. That is, the pin 170 is spaced from the spring 500, which improves the performance of the resilient seal.

Figure 20:
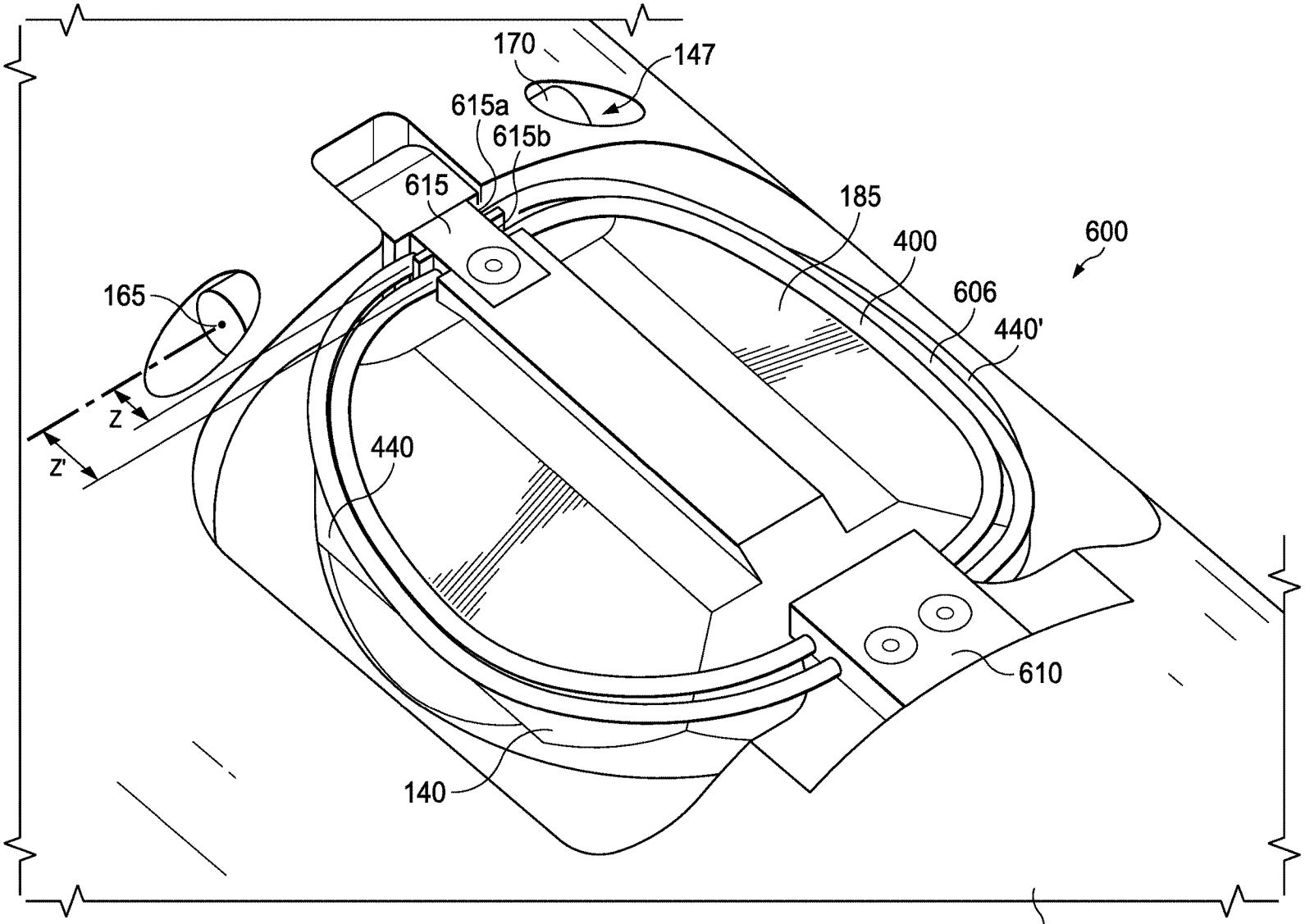
FIG. 20 is a perspective view of a portion of another embodiment of subsurface flapper valve of FIGS. 11A-11B in the valve open position, according to another example embodiment of the present disclosure.

Another embodiment of the valve assembly 135 is identified by the reference numeral 600 illustrated in FIG. 20. The valve assembly 600 includes the spring 400 and a spring 606 that is substantially similar to the spring 400 except for the size of the spring 606, which may be larger or smaller than the spring 400. Reference numerals used to refer to the features of the spring 606 that are substantially identical to the features of the spring 400 will correspond to the reference numerals used to refer to the features of the spring 400 except that the prefix for the reference numerals used to refer to the features of the spring 400, that is, 400, will be replaced by the prefix of the spring 606, that is, 606. In some embodiments, the use of two springs (i.e., spring 400 and 606) results in maximizing compressional loads that are associated with heavy flappers or plates.

In some embodiments, the spring 606 reinforces the elastic properties of the spring 400 and increases the torque output. Pinning the spring 606 further from the pivot point 165 yields higher deflection when the plate 140 opens. That is, the spring 400 is pinned at the distance Z' from the pivot point 165 while the spring 606 is pinned at the distance Z from the pivot point 165, with Z' being larger than Z. In some embodiments, the spring 606 has a smaller cross-section and/or lower "E" to produce higher deflection to result in a less-than-stiff spring to produce a lower load. In an example embodiment, both of the springs 400 and 606 are accommodated (in a stacked formation) in the grooves, such as the groove 440 and a groove 440', formed on the surface 185 of the plate 140.

Figure 21:
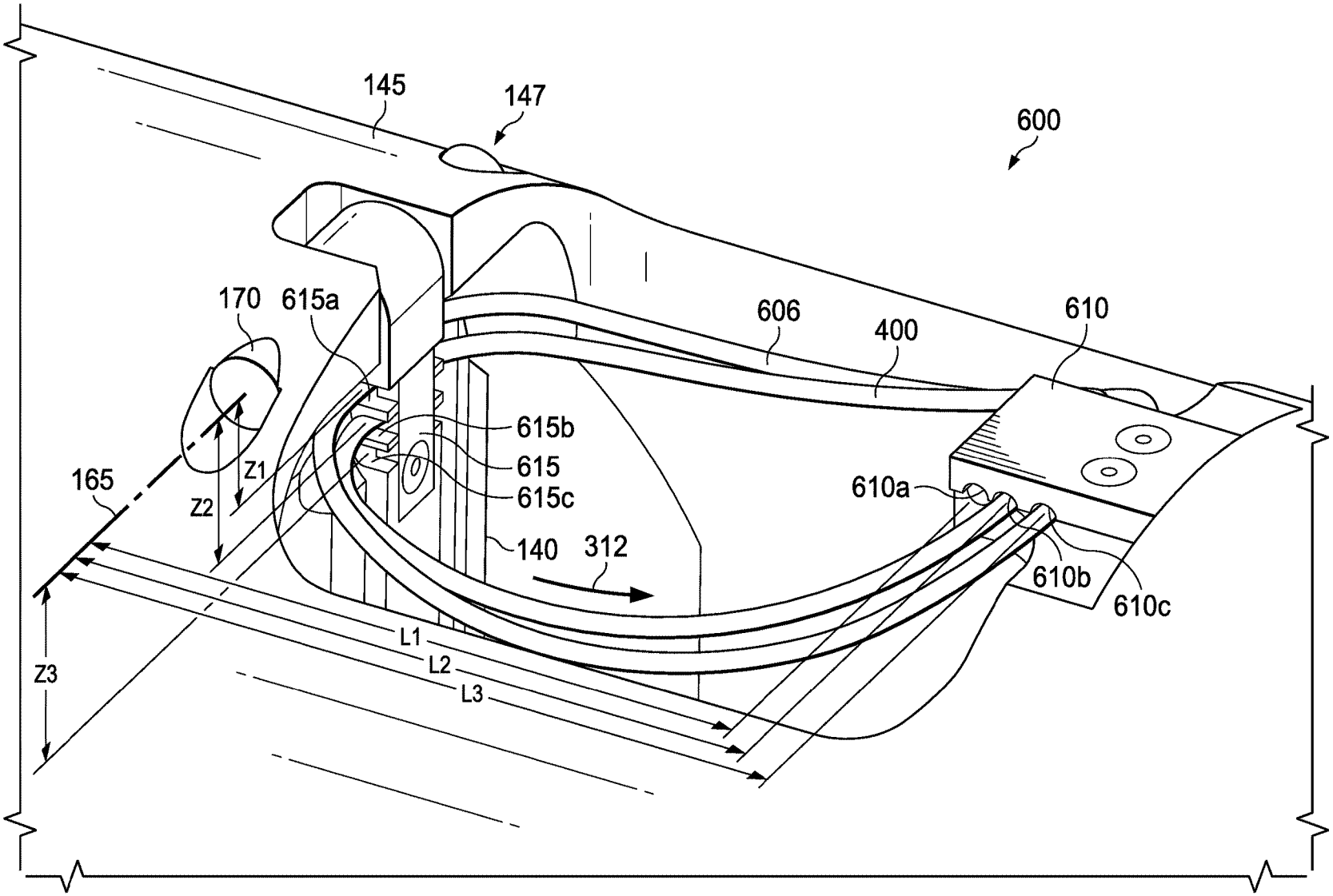
FIG. 21 is a perspective view of a portion of the subsurface flapper valve of FIG. 20 in the valve closed position, according to another example embodiment of the present disclosure.

In some embodiments and as illustrated in FIG. 21, couplers 610 and 615 pin the springs 400 and 606 to the sub 145. Each of the couplers 610 and 615 includes multiple pin positions 610*a*, 610*b*, 610*c*, 615*a*, 615*b*, 615*c*, respectively to allow for one from a plurality of distances Z1, Z2, Z3 and L1, L2, L3 to be selected.

In some embodiments, the coupler 610 is omitted and the fulcrum assembly 455 pins the springs 400 and 606 to the sub 145. In other embodiments, the coupler 610 includes the pin 460 and it extends across both the springs 400 and 606.

Figure 22:
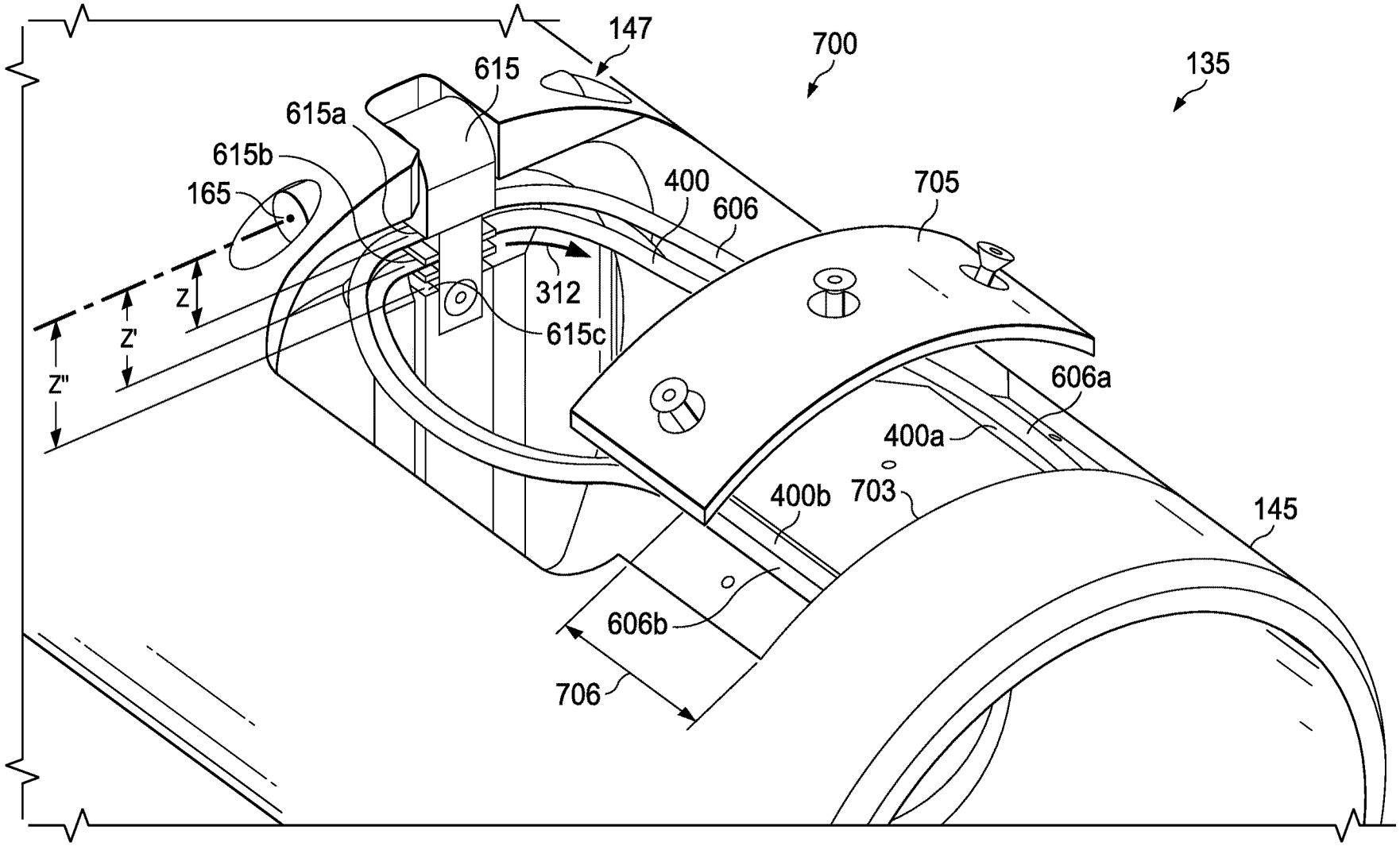
FIG. 22 is a perspective view of a portion of another embodiment of the subsurface flapper valve of FIG. 20 in the valve closed position, according to yet another example embodiment of the present disclosure.

Another embodiment of the valve assembly 135 is identified by the reference numeral 700 illustrated in FIG. 22. The valve assembly 700 is identical to the valve assembly 600 except that the bridge portions 400*c* and 606*c* are omitted and portions of the arms 400*a*, 400*b*, 606*a*, and 606*b* are trapped (in the radial direction) between the sub 145 and a plate 705 to fix the arms 400*a*, 400*b*, 606*a*, and 606*b* relative to the sub 145. Thus, the springs 606 and 400 form a wheelbarrow shape. In the longitudinal direction, ends of the arms 400*a*, 400*b*, 606*a*, and 606*b* engage a stop 703 formed in the sub 145. A length 706 of the arms 400*a*, 400*b*, 606*a*, and 606*b* in part affect the deformation of the springs 400 and 606 in the pre-set, closed, and open positions. In some embodiments, the distances Z, Z', and Z" are adjustable via the coupler 615. In some embodiments, the length 706 of each of the arms 400*a*, 400*b*, 606*a*, 606*b* is altered, the position of the stop 703 relative to the pivot point 165 is altered; and/or a shim or other block is positioned between the stop 703 and the ends of the arms 400*a*, 400*b*, 606*a*, and 606*b* to change the deformation of the springs 400 and 606.

Figure 23:
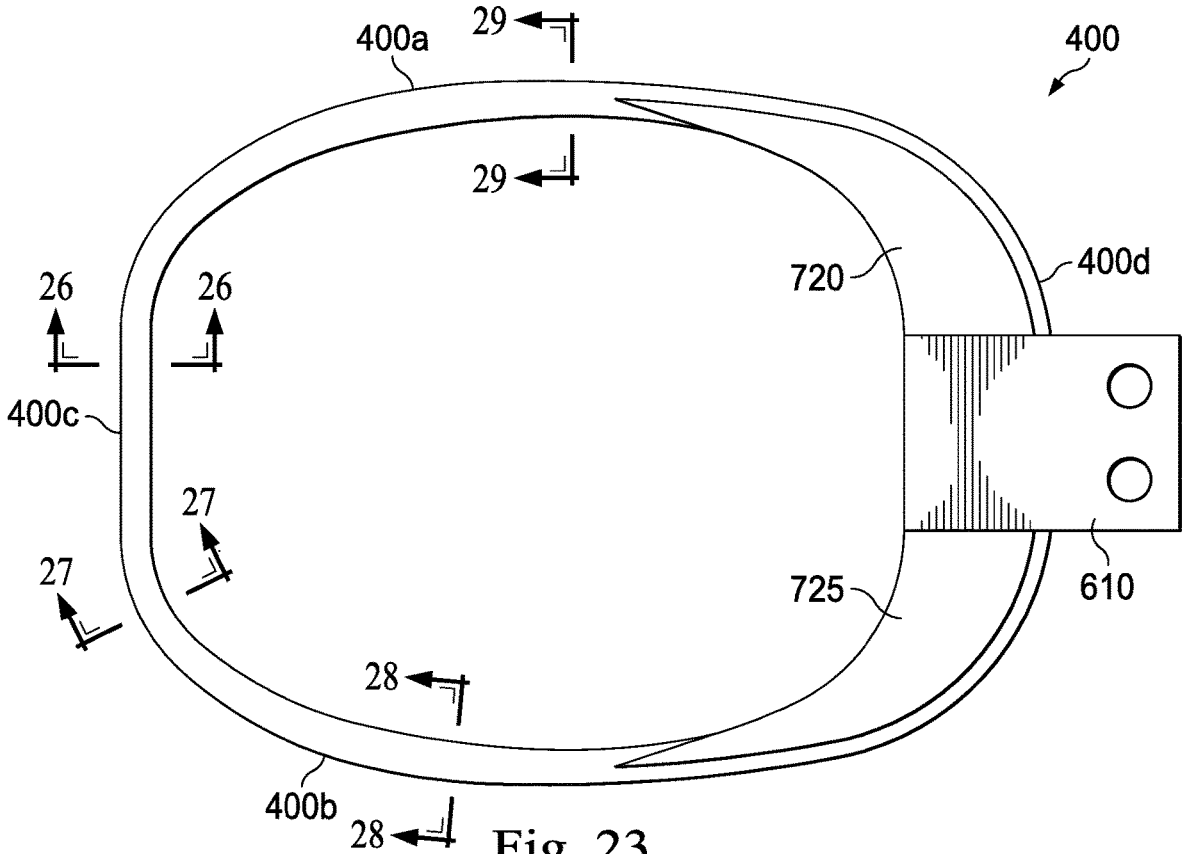
FIG. 23 is a top view of another embodiment of the spring of FIG. 17, according to an embodiment of the present disclosure.
Figure 24:
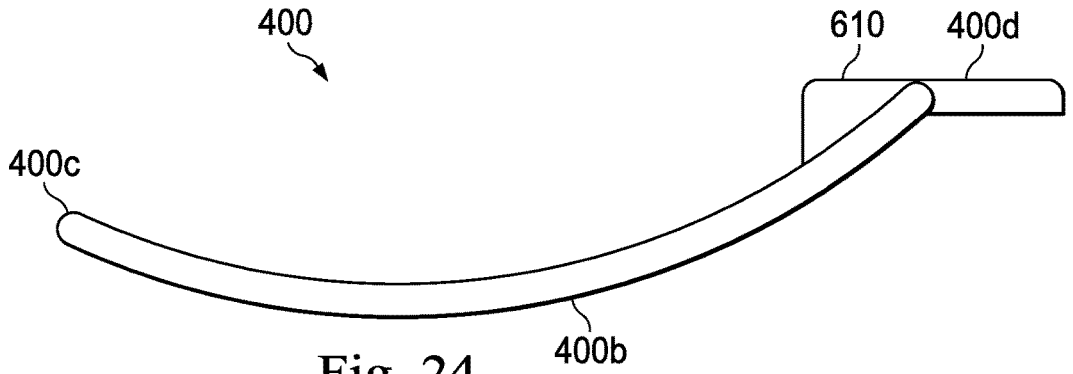
FIG. 24 is a side view of the spring of FIG. 23, according to an example embodiment.
Figure 25:
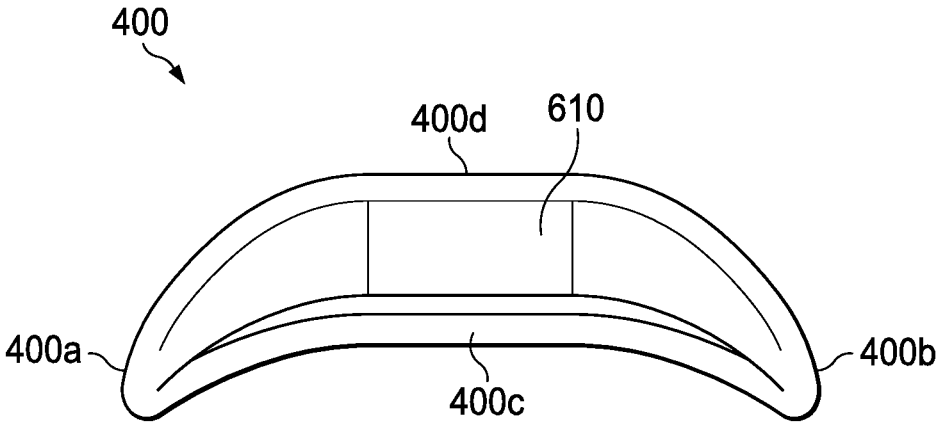
FIG. 25 is a front view of the spring of FIG. 23, according to an example embodiment.
Figure 26:
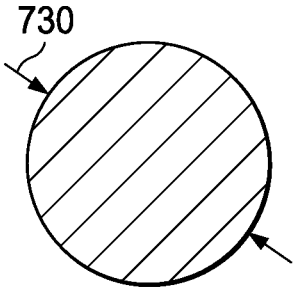
FIG. 26 is a sectional view of a portion of the spring of FIG. 23, according to an embodiment of the present disclosure.
Figure 27:
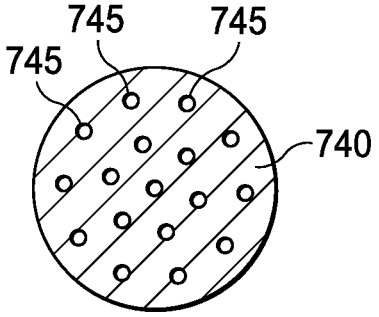
FIG. 27 is a sectional view of another portion of the spring of FIG. 23, according to an embodiment of the present disclosure.
Figure 28:
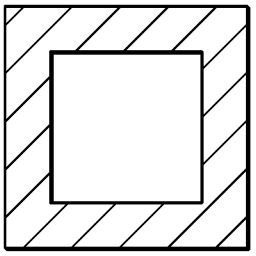
FIG. 28 is a sectional view of another portion of the spring of FIG. 23, according to an embodiment of the present disclosure.
Figure 29:
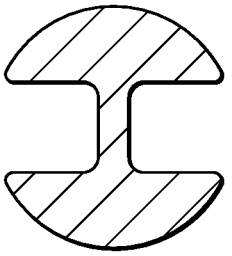
FIG. 29 is a sectional view of another portion of the spring of FIG. 23, according to an embodiment of the present disclosure.

The geometry of the arms 400*a* and 400*b* and the bridge portions 400*c* and 400*d* can vary, as illustrated in FIGS. 23-25. In some embodiments, bridge portion 400*d* and the coupler 610 are integrally formed and supports 720 and 725 extend between a portion of the coupler 610 and the arms 400*a* and 400*b*, respectively. In some embodiments, the supports 720 and 725 extend along a portion of the arms 400*a* and 400*b* to generate necessary stresses in the spring 400 to close or open the flapper 140. In some embodiments, and as shown in FIG. 26, the cross-section of the bridge portion 400*c* has a solid circular shape defining a diameter 730. However, the cross-section of the bridge portion 400*c* or other portion of the spring 400 is not limited to a solid or circular shape. For example, and as illustrated in FIG. 27, a cross-section of the arms 400*a*, 400*b* or bridge portions 400*c*, 400*d* may form a circular shape formed by a material 740 in which voids or chambers 745 are formed within the material 740. In some embodiments, the voids or chambers 745 are filled with a material that is different from the material 740. In other embodiments, a cross-section of the arms 400*a*, 400*b* or bridge portions 400*c*, 400*d* may form a hollow square shape as illustrated in FIG. 28 or an "I" shape or an "H" shape as illustrated in FIG. 29. Moreover, the diameter 730 of the bridge portion 400*c*, shape of the cross-section of the bridge portion 400*c*, and/or dimension of the cross-sections of the bridge portion 400*c* can vary along the bridge portion 400*c* and/or relative to the arm 400*a*, the arm 400*b*, and the bridge portion 400*d*. The same applies to the arms 400*a*, 400*b*, and bridge portion 400*d*. In some embodiments, the cross-section of the arms 400*a*, 400*b* and the bridge portions 400*c*, 400*d* can form any number of shapes and sizes. In some embodiments, the arms 400*a*, 400*b* and bridge portions 400*c*, 400*d* can form any number of shapes and sizes. In some embodiments, the spring 400 is composed of a composite material. In some embodiments, the spring 400 is a 3D printed spring.

Figure 30:
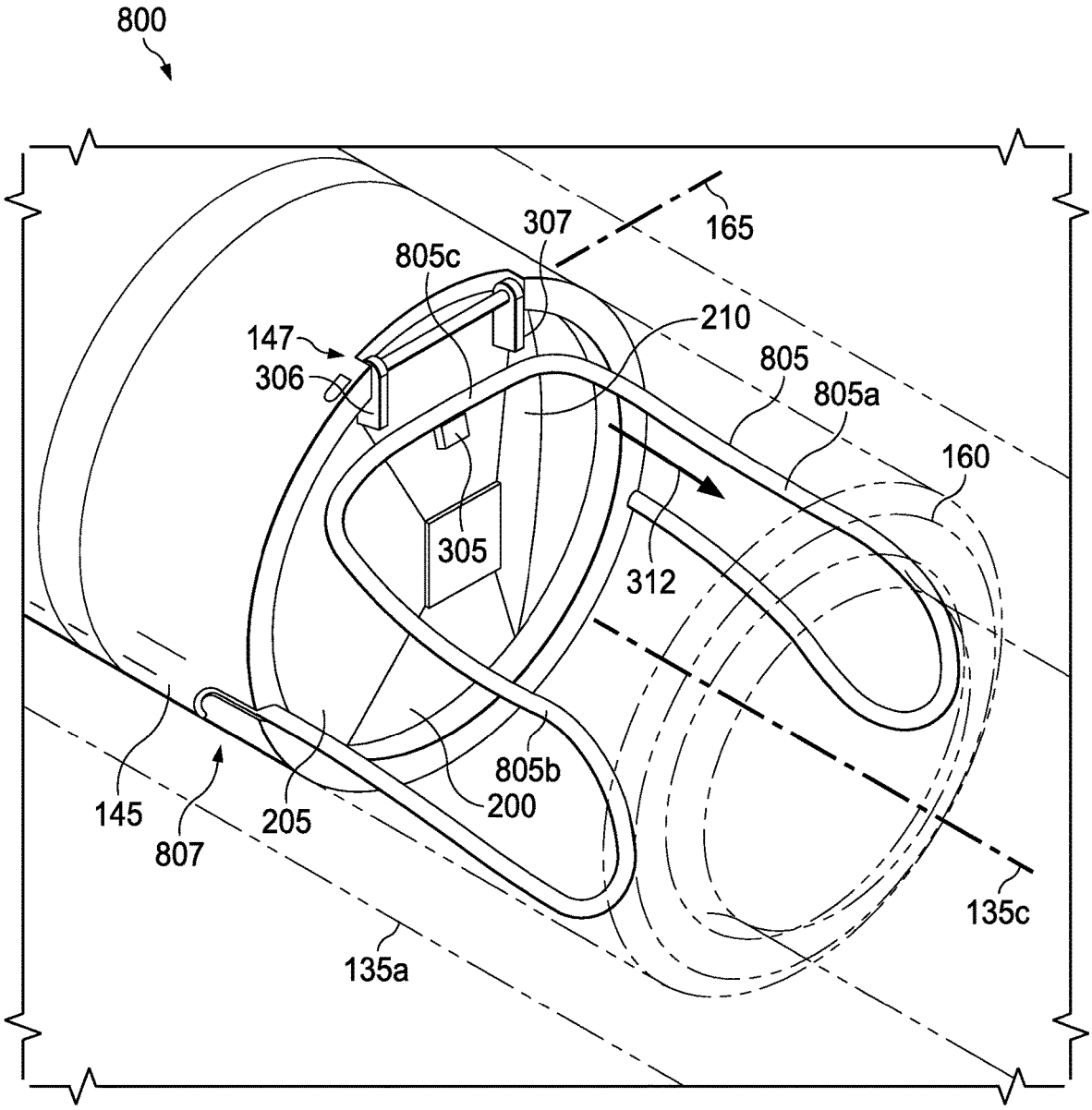
FIG. 30 is a perspective, partially cut-away view of another example embodiment of the valve of FIGS. 11A and 11B in the valve closed position, according to an example embodiment of the present disclosure.
Figure 31:
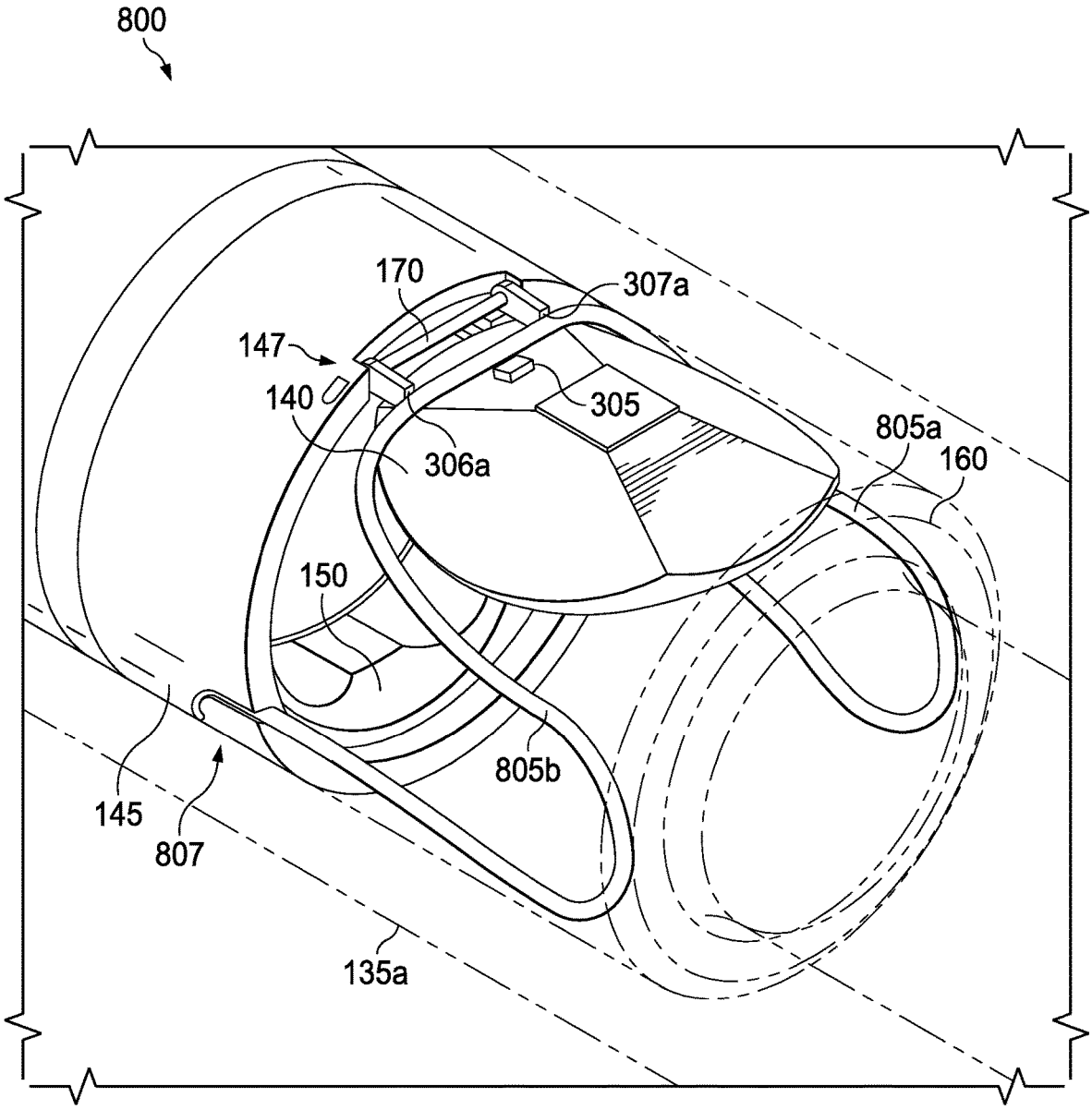
FIG. 31 is a perspective, partially cut-away view of the valve of FIG. 30 in the valve open position, according to an embodiment of the present disclosure.
Figure 32:
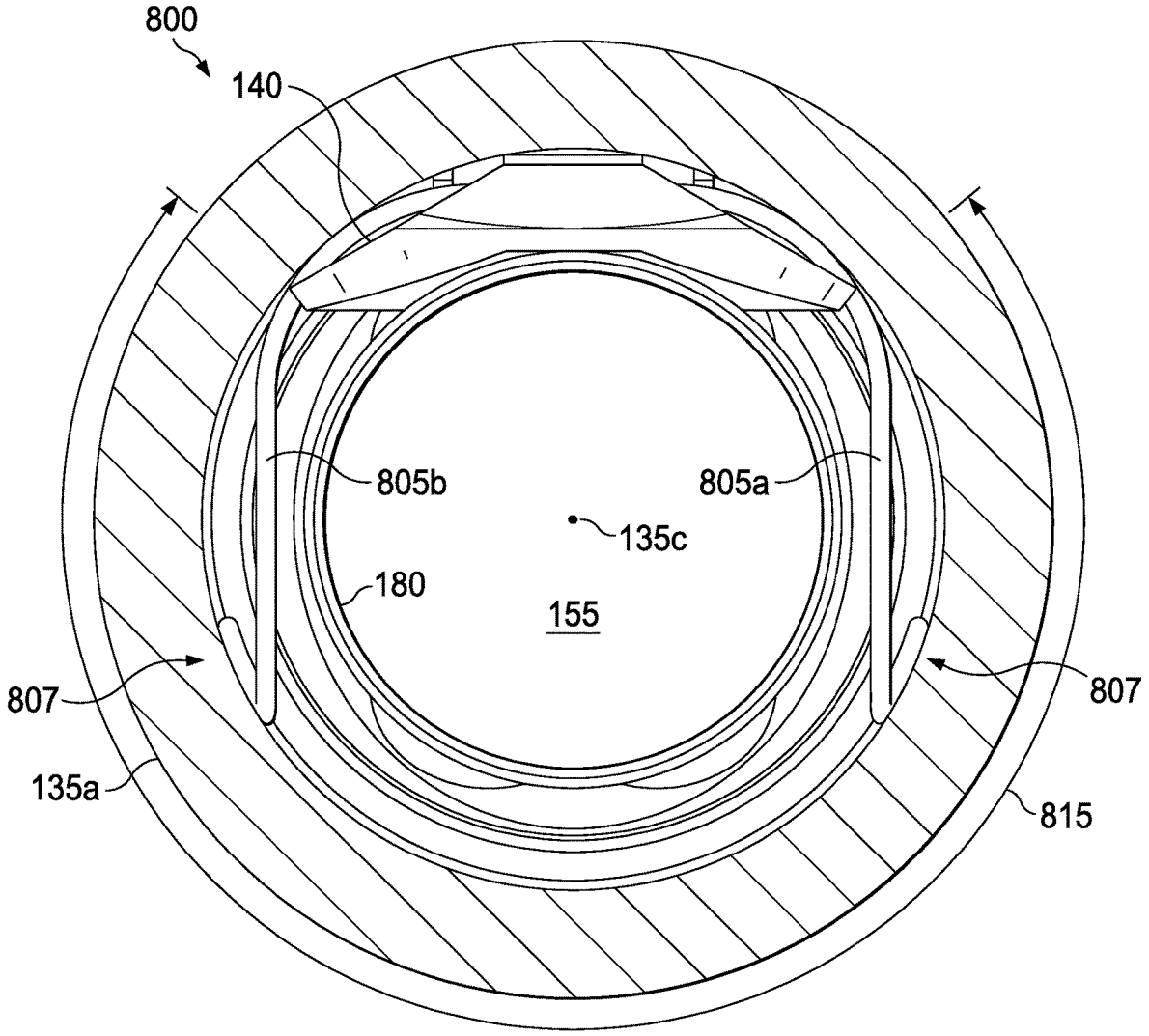
FIG. 32 is a cross-sectional view of the valve of FIGS. 30 and 31 in the valve open position, according to an embodiment of the present disclosure.

Another embodiment of the valve assembly 135 is identified by the reference numeral 800 illustrated in FIGS. 30-32. The valve assembly 800 includes a spring 805. Reference numerals used to refer to the features of the spring 805 that are substantially identical to the features of the spring 175 will correspond to the reference numerals used to refer to the features of the spring 175 except that the prefix for the reference numerals used to refer to the features of the spring 175, that is, 175, will be replaced by the prefix of the spring 805, that is, 805. Generally, the bridge portion 805*d* of the spring 805 is omitted and each of the arms 805*a* and 805*b* double back towards the pivot point 165 and are embedded in and/or engages the sub 145 at locations 807 relative to the axis 135*c*. In some embodiments, the pivot point 165 extends between, in the direction aligned with the axis 135*c*, the locations 807 and the internal shoulder 160. As such, the arms 805*a* and 805*b*, when viewed in a cross-sectional view along the axis 135*c*, form a hairpin-like shape. In some embodiments, the locations 807 are within a circumferential portion identified by the numeral 815 in the FIG. 32. In some embodiments and when the locations 807 are within the circumferential portion 815, the sub 145 extends toward the internal shoulder 160 and the locations 807 are between the internal shoulder 160 and the pivot point 165. That is, in some embodiments the pivot point 165 does not extend between the locations 807 and the shoulder 160. Regardless, the spring 805 biases the flapper plate 140 to the closed position. Generally, the locations 807 affect the rotational force applied to the plate 140.

In some embodiments, calculation of the deflection of each of the springs 175, 350, 400, 500, 606, and 805 is based on the following equation:

$$y=3EI/FL^3 \quad (1)$$

Where:

F=force

L=length

E=Young's modulus

I=moment of inertia

With I for rectangular cross-section is:

$$I=1/12bh^3 \quad (2)$$

Where:

b=base of cross-section h=height of cross-section r=radius of cross-section

With I for round cross-section is:

$$I=((\pi/4)*r^4) \quad (3)$$

Generally, at least a portion of each of the springs 175, 350, 400, 500, 606, and 805 extends within the flapper valve chamber 155. Generally, at least a portion of each of the springs 175, 350, 400, 500, 606, and 805 extends away from the flapper plate 140 and towards the internal shoulder 160 when the flapper plate 140 is in the closed position. In some embodiments, each of the springs 175, 350, 400, 500, 606, and 805 extends away from the flapper plate 140 in the direction illustrated in the arrow 312 (FIGS. 2, 6, 11A, 11B, 14, 15, 19, 21, 22, and 30).

Figure 37:
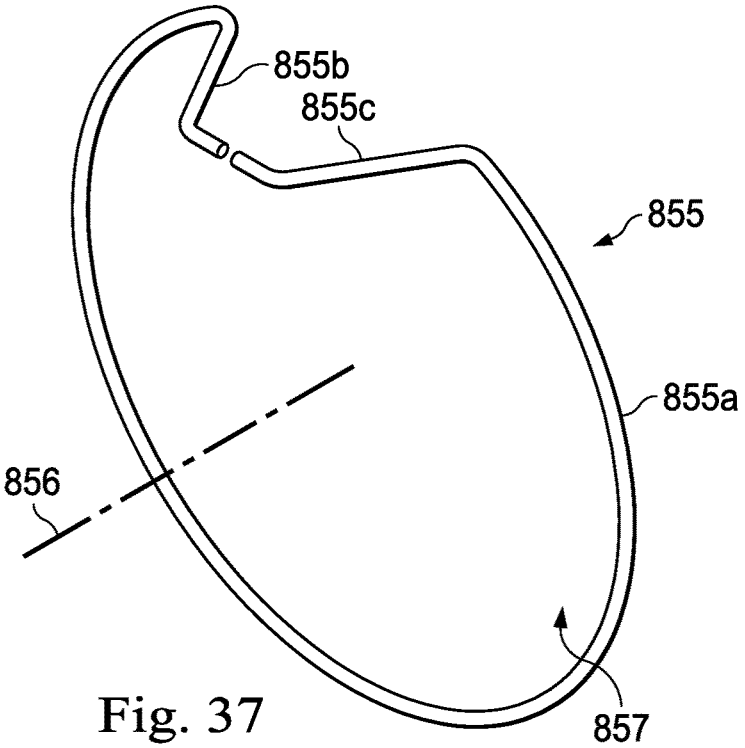
FIG. 37 is a perspective view of the spring of FIG. 33, according to an embodiment of the present disclosure.

Another embodiment of the valve assembly 135 is identified by the reference numeral 850 illustrated in FIGS. 33-36. The valve assembly 850 includes a spring 855. Generally, the spring 855 includes a retainer ring 855*a* positioned between a first arm 855*b* and a second arm 855*c*. In some embodiments, the spring 855 is formed from a wire that is shaped to form the retainer ring 855*a*, the first arm 855*b*, and the second arm 855*c*. In some embodiments and as illustrated in FIG. 37, the arms 855*b* and 855*c* protrude or extend along an axis that is parallel with a longitudinal axis 856 of an opening 857 formed by the retainer ring 855*a* when in a free state (when not installed in the valve assembly 850). The protrusion of the arms 855*b* and 855*c* causes the arms 855*b* and 855*c* to deform or become energized when the spring 855 is installed or forms a part of the valve assembly 850.

In some embodiments and referring back to FIGS. 33-36, a wall of the hinge sub 145 forms a radially extending surface 860 that is spaced longitudinally from the valve seat 150. In some embodiments, the retainer ring 855*a* is positioned against the surface 860 such that the retainer ring 855*a* at least partially surrounds the interior passageway 135*b*. In some embodiments, a c-shaped plate 865 (shown in FIGS. 33, 34, and 36 and not shown in FIG. 35) is secured against the surface 860 to sandwich the retainer ring 855*a* between the surface 860 and the c-shaped plate 865. In some embodiments, a channel 866 is formed in one surface of the c-shaped plate 865 and the channel 866 is sized to receive the retainer ring 855*a*. In some embodiments, a plurality of screw holes 858 is formed in the c-shaped plate 865 and in the surface 860 such that the c-shaped plate 865 is secured to the hinge sub 145 via threaded screws 859. Moreover, and in some embodiments, one of the threaded screws 859 engages the spring 855 and the c-shaped plate 865 to secure the spring 855 to the c-shaped plate 865 and the hinge sub 145. However, the c-shaped plate 865 can be coupled to the hinge sub 145 in a variety of ways.

In this embodiment, a longitudinal axis of the opening 857 formed by the retainer ring 855*a* is parallel to, or coaxial with, the longitudinal axis 135*c* of the housing 135*a*. Moreover, the retainer ring 855*a* at least partially surrounds the interior passageway 135*b*. As illustrated, the retainer ring 855*a* surrounds at least 270 degrees of the interior passageway 135*b*, at least 220 degrees of the interior passageway 135*b*, at least 200 degrees of the interior passageway 135*b*, and/or at least 180 degrees of the interior passageway 135*b*.

Figure 33:
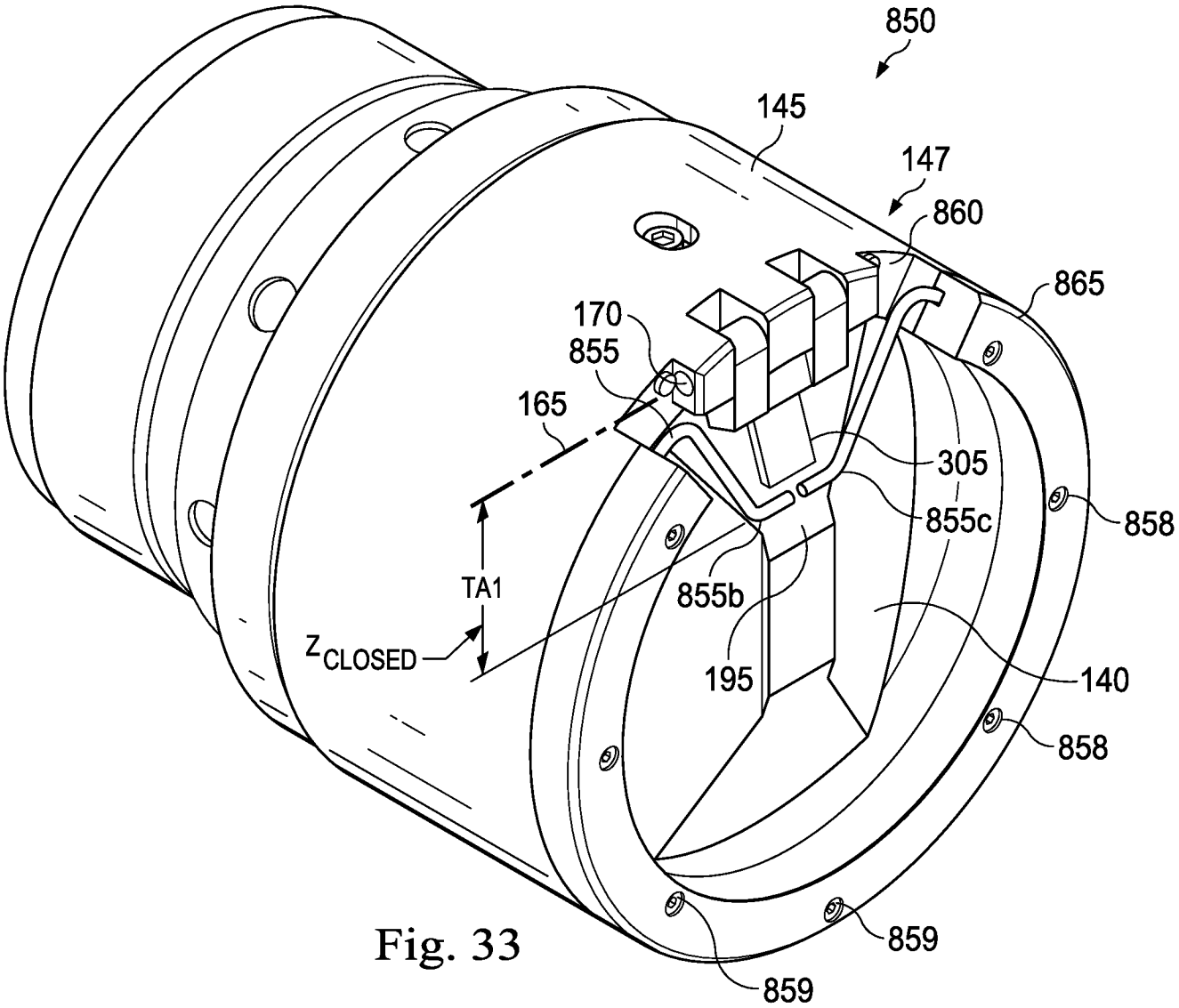
FIG. 33 is a perspective view of another example embodiment of the valve of FIG. 2 in the valve closed position, according to an example embodiment of the present disclosure, the valve including a spring and a c-shaped plate.
Figure 34:
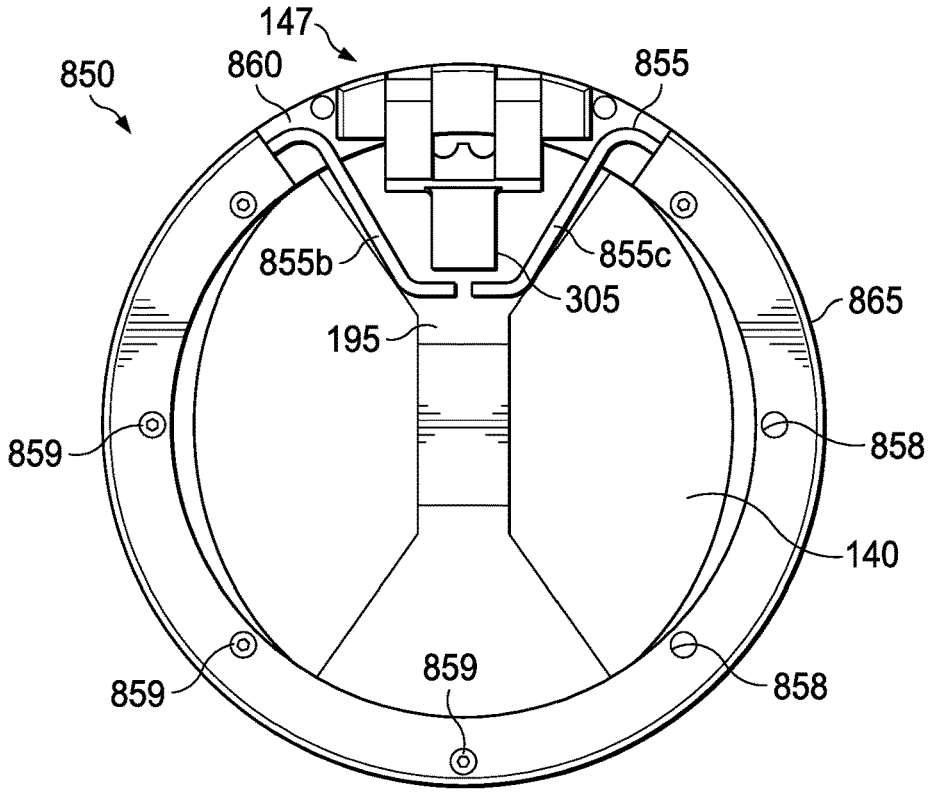
FIG. 34 is an end view of the valve of FIG. 33 in the valve closed position, according to an embodiment of the present disclosure.
Figure 35:
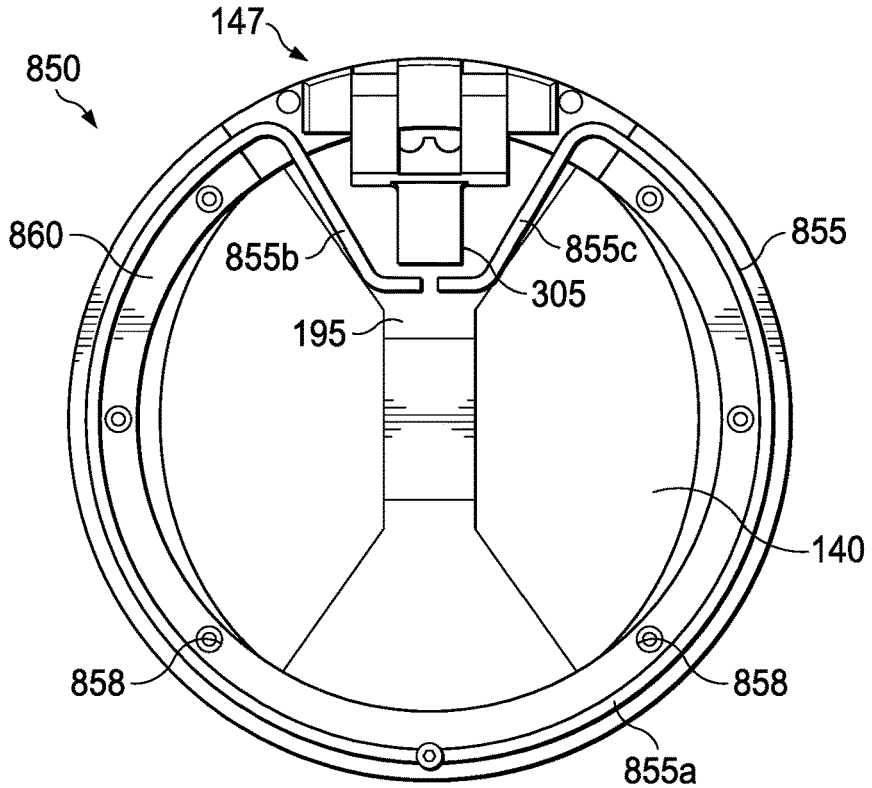
FIG. 35 is an end view of the valve of FIG. 33 in the valve closed position with the c-shaped plate hidden, according to an embodiment of the present disclosure.
Figure 36:
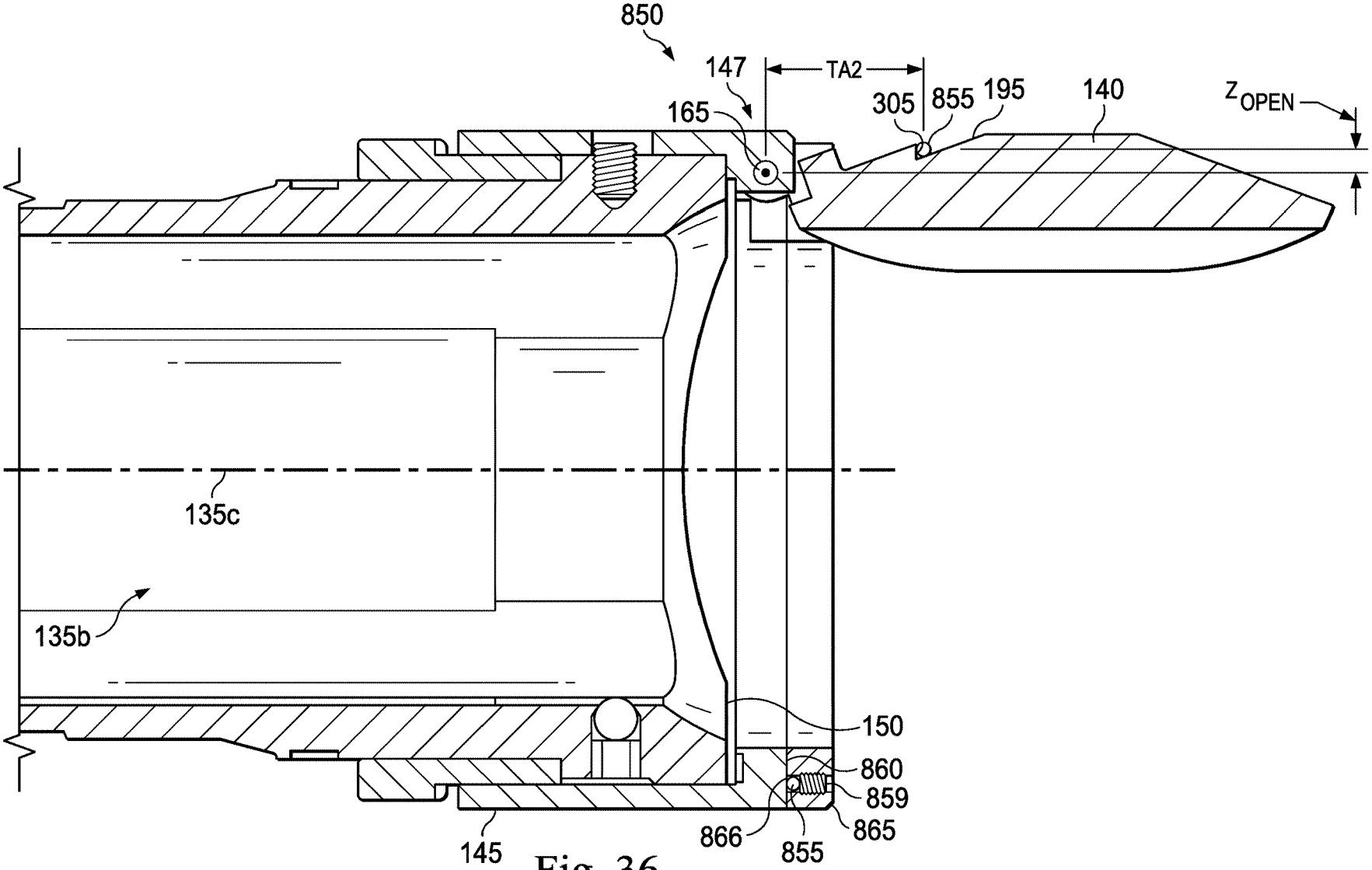
FIG. 36 is a cross-sectional view of the valve of FIG. 33 in the valve open position, according to an embodiment of the present disclosure.

In some embodiments, the arms 855*b* and 855*c* contact the flapper plate 140 generally on the top portion 195 of the upper surface 185 of the flapper plate 140. In some embodiments and as illustrated in FIGS. 33, 34, and 35, the stop 305 engages the arms 855*b* and 855*c* when the flapper plate 140 is in the open position to stop the movement of the arms 855*b* and 855*c* in a direction towards the hinge assembly 147. When the flapper plate 140 moves to the closed position, the arms 855*b* and 855*c* slide against the top portion 195 of the upper surface 185 to provide for a variable torque spring. Similar to the valve assembly 135, the TA1 is different than the TA2. Namely the first torque arm, TA1, which is associated with the flapper plate 140 being in the closed position, is greater than the second torque arm, TA2, which is associated with the flapper plate 140 being in the open position. The ability to change torque arm distances maximizes torque applied to the flapper plate 140 when the flapper plate 140 is in the closed position. As the arms 855*b* and 855*c* slide across the upper surface 185 of the flapper plate 140 to reduce TA1 to TA2, the valve assembly 850 is a variable torque valve. That is, the location along the flapper plate (measured along the axis 140*a*) at which the spring 855 applies load varies between the open and closed position to provide variable torque.

As illustrated, the spring 855 is spaced in its entirety from the hinge assembly 147 when in the valve closed position and the valve open position. Specifically, there is no portion (s) of the spring 855 that is in contact with the pin 170.

Figure 38:
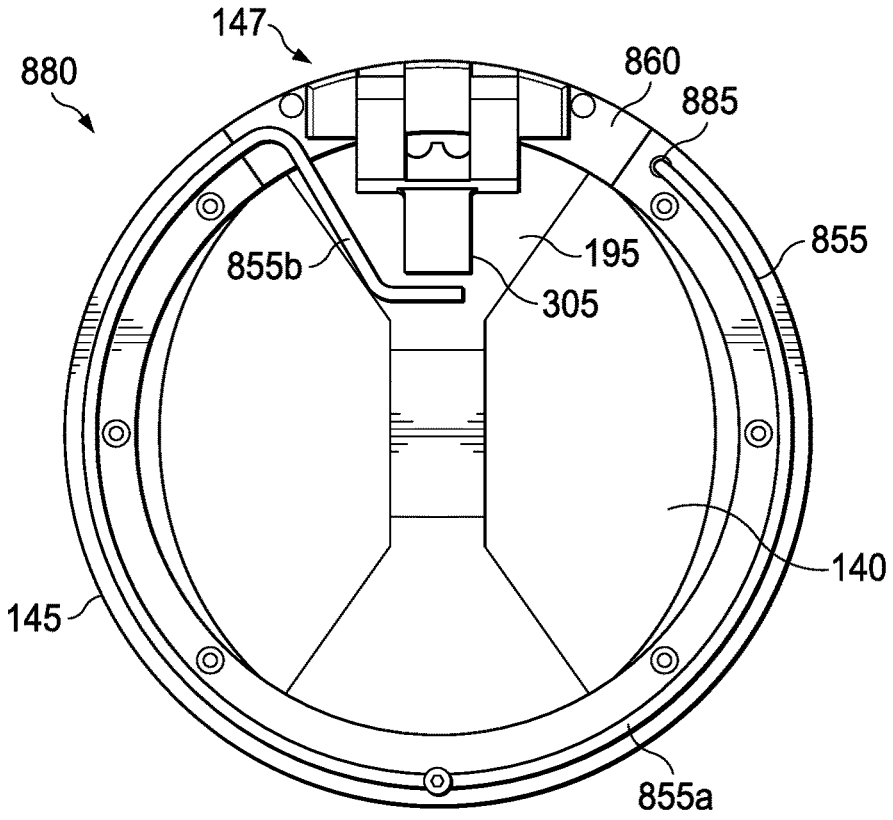
FIG. 38 is a side view of another example embodiment of the valve of FIG. 33 in the valve closed position, according to an example embodiment of the present disclosure.

Another embodiment of the valve assembly 850 is identified by the reference numeral 880 is illustrated in FIG. 38 (the c-shaped plate 865 is not shown). The valve assembly 880 is identical to the valve assembly 850 except that the arm 855*c* does not contact the flapper plate 140. Instead, the arm 855*c* extends into a bore 885 formed in the wall of the hinge sub 145 to reduce stress in the spring 855. In some embodiments, the bore 885 extends in a direction parallel to the longitudinal axis 135*c*.

In some embodiments, the springs 175, 350, 400, 500, 606, 805, and 855 do not require clearance near the pivot pin 170, and thus allow for increased sizes, as thus strength, of the flapper plate 140 and the pivot pin 170.

In some embodiments, the springs 175, 350, 400, 500, 606, 805, and 855 apply a force to the flapper plate 140 to urge the plate 140 to an open or closed position. That is, each of the springs 175, 350, 400, 500, 606, 805, and 855 provides a holding force to hold the flapper plate 140 in either an open or closed position. In some embodiments, when the flapper plate 140 is moved out of the open or closed position past a fulcrum point, each of the springs 175, 350, 400, 500, 606, 805, and 855 applies a force to the flapper to urge it to the opposite position (i.e. from closed to open, or from open to closed). This occurs when the force applied by the springs 175, 350, 400, 500, 606, 805, and 855 is applied at a point that is past the pivot point of the flapper plate 140. Therefore, the force would be applied to one side of the pivot point in one position (e.g., Zclosed is measured from one side of pivot point 165 and Zopen is measured from another side of pivot point 165 in FIG. 7) and applied to the opposite side of the pivot point in another position.

In some embodiments, the springs 175, 350, 400, 500, 606, and 805 apply a force to the right and left side portions 205 and 210 of the flapper plate 140 when the flapper plate 140 is in the open position because the springs 175, 350, 400, 500, 606, and 805 engage the right and left side portions 205 and 210 of the flapper plate 140 to urge it away from the open position, in addition to the force applied to the flapper plate 140 via the bridge portions 175*c*, 350*c*, 400*c*, 500*c*, 606*c*, and 805*c*, which increases the surface area through which the force of the spring is applied to the flapper plate 140.

Various attachment points of the springs 175, 350, 400, 500, 606, and 805 to the flapper plate 140 and the housing 135*a* or the sub 145 provide a wide range of forces to accommodate various flapper valve designs.

In some embodiments, while the springs 175, 350, 400, 500, 606, and 805 are considered to be compression springs, some or all of the springs 175, 350, 400, 500, 606, and 805 are considered torsion springs or beam springs. In some embodiments, the bridge portions 175*c*, 350*c*, 400*c*, 500*c*, 606*c*, and 805*c* are spaced longitudinally between the pivot point 165 and the shoulder 160, which allows for the size of pivot pin 170 and/or surrounding elements to be enlarged. In some embodiments, each of the springs 175, 350, 400, 500, 606, 805, and 855 does not require space at the pivot pin 170.

In some embodiments, the springs 175, 350, 400, 500, 606, 805, and 855 are sized to accommodate a variety of plate sizes and weights.

In some embodiments, and when the distances Z and/or Z' for the springs 400 and 606, respectively, can be adjusted prior to the valve assembly 135 being run downhole, the valve assembly 135 is a valve with adjustable torque.

In some embodiments, each of the springs 175, 350, 400, 500, 606, and 805 is a beam spring with torsional properties for operating the valve assembly 135.

In some embodiments, the springs 175, 350, 400, 500, 606, and 805 are different from a traditional torsion spring in that spring forces acting on the springs 175, 350, 400, 500, 606, and 805 are bending stresses while the forces acting on a torsion spring are torsional stresses.

In some embodiments and due to the shape of the springs 175, 350, 400, 500, 606, 805, and 855, the forces acting on the plate 140 are positioned away from the hinge assembly 147 (e.g., the pivot point 165 and the flapper pin 170). This allows the forces generated by the springs 175, 350, 400, 500, 606, 805, and 855 to avoid any critical areas of the flapper plate 140 and to be symmetrically centralized to generate extremely high flapper torque outputs.

Generally, the flapper torque is maximized by allowing the springs 175, 350, 400, 500, 606, and 805 to deflect both laterally and axially through compression.

While a concentric piston-type operated tubing-retrievable safety valve is illustrated here, the springs 175, 350, 400, 500, 606, 805, and 855 are capable of being used in a variety of other types of valves, such as a rod piston operated valve, an electric actuator type valve, etc. Moreover, the springs 175, 350, 400, 500, 606, 805, and 855 may be used with a variety of flapper closure plates.

In this disclosure, the description of one axis being perpendicular to another axis is used when the one axis is in a plane that is perpendicular to the plane in with the another axis lies. That is, although the one axis and the another axis do not intersect, they are considered perpendicular to one another.

Figure 39:
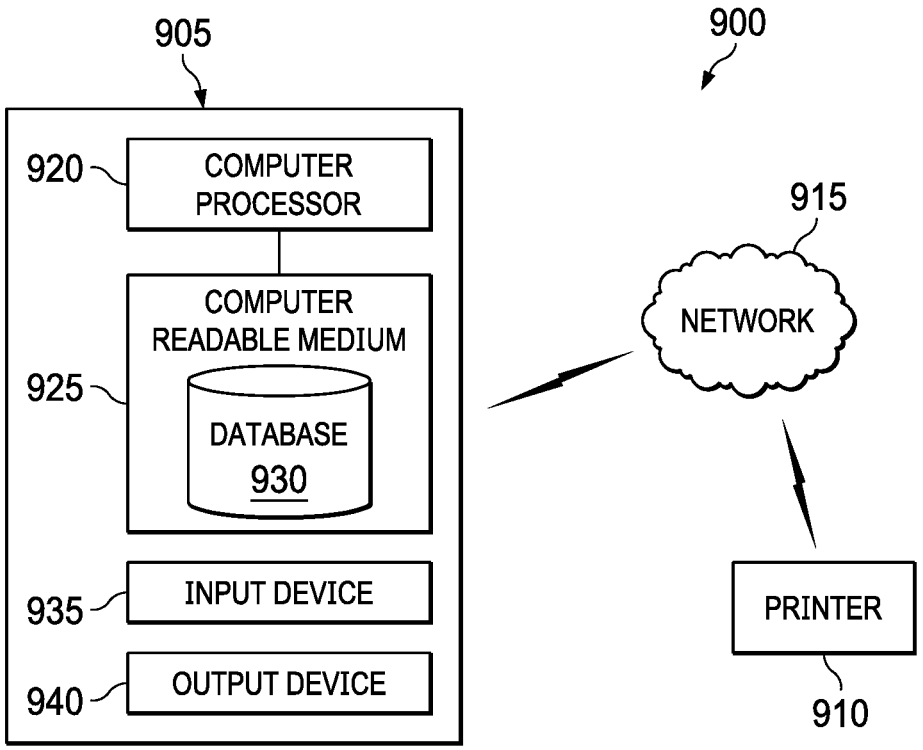
FIG. 39 illustrates an additive manufacturing system, according to an example embodiment.

In an example embodiment and as shown in FIG. 39, a down-hole tool printing system 900 includes one or more computers 905 and a printer 910 that are operably coupled together, and in communication via a network 915. In one or more example embodiments, the springs 175, 350, 400, 500, 606, 805, and 855 and/or portions of the valve assembly 135 may be manufactured using the downhole tool printing system 900. In one or more example embodiments, the one or more computers 905 include a computer processor 920 and a computer readable medium 925 operably coupled thereto. In one or more example embodiments, the computer processor 920 includes one or more processors. Instructions accessible to, and executable by, the computer processor 920 are stored on the computer readable medium 925. A database 930 is also stored in the computer readable medium 925. In one or more example embodiments, the computer 905 also includes an input device 935 and an output device 940. In one or more example embodiments, web browser software is stored in the computer readable medium 925. In one or more example embodiments, three-dimensional modeling software is stored in the computer readable medium. In one or more example embodiments, software that includes advanced numerical methods for topology optimization, which assists in determining optimum chamber shape, chamber size distribution, and chamber density distribution or other topological features in the springs 175, 350, 400, 500, 606, and 805 and/or portions of the valve assembly 135, is stored in the computer readable medium. In one or more example embodiments, software involving finite element analysis and topology optimization is stored in the computer readable medium 925. In one or more example embodiments, any one or more constraints are entered in the input device 935 such that the software aids in the design on the springs 175, 350, 400, 500, 606, 805, and 855 and/or portions of the valve assembly 135 in which specific portions of the body of the springs 175, 350, 400, 500, 606, 805, and 855 and/or portions of the valve assembly 135 remain solid (i.e., no chambers are formed). In one or more example embodiments, the input device 935 is a keyboard, mouse, or other device coupled to the computer 905 that sends instructions to the computer 905. In one or more example embodiments, the input device 935 and the output device 940 include a graphical display, which, in several example embodiments, is in the form of, or includes, one or more digital displays, one or more liquid crystal displays, one or more cathode ray tube monitors, and/or any combination thereof. In one or more example embodiments, the output device 940 includes a graphical display, a printer, a plotter, and/or any combination thereof. In one or more example embodiments, the input device 935 is the output device 940, and the output device 940 is the input device 935. In several example embodiments, the computer 905 is a thin client. In several example embodiments, the computer 905 is a thick client. In several example embodiments, the computer 905 functions as both a thin client and a thick client. In several example embodiments, the computer 905 is, or includes, a telephone, a personal computer, a personal digital assistant, a cellular telephone, other types of telecommunications devices, other types of computing devices, and/or any combination thereof. In one or more example embodiments, the computer 905 is capable of running or executing an application. In one or more example embodiments, the application is an application server, which in several example embodiments includes and/or executes one or more web-based programs, Intranet-based programs, and/or any combination thereof. In one or more example embodiments, the application includes a computer program including a plurality of instructions, data, and/or any combination thereof. In one or more example embodiments, the application written in, for example, HyperText Markup Language (HTML), Cascading Style Sheets (CSS), JavaScript, Extensible Markup Language (XML), asynchronous JavaScript and XML (Ajax), and/or any combination thereof.

In one or more example embodiments, the printer 910 is a three-dimensional printer. In one or more example embodiments, the printer 910 includes a layer deposition mechanism for depositing material in successive adjacent layers; and a bonding mechanism for selectively bonding one or more materials deposited in each layer. In one or more example embodiments, the printer 910 is arranged to form a unitary printed body by depositing and selectively bonding a plurality of layers of material one on top of the other. In one or more example embodiments, the printer 910 is arranged to deposit and selectively bond two or more different materials in each layer, and wherein the bonding mechanism includes a first device for bonding a first material in each layer and a second device, different from the first device, for bonding a second material in each layer. In one or more example embodiments, the first device is an ink jet printer for selectively applying a solvent, activator or adhesive onto a deposited layer of material. In one or more example embodiments, the second device is a laser for selectively sintering material in a deposited layer of material. In one or more example embodiments, the layer deposition means includes a device for selectively depositing at least the first and second materials in each layer. In one or more example embodiments, any one of the two or more different materials may be ABS plastic, PLA, polyamide, glass filled polyamide, stereolithography materials, silver, titanium, steel, wax, photopolymers, polycarbonate, and a variety of other materials. In one or more example embodiments, the printer 910 may involve fused deposition modeling, selective laser sintering, and/or multi jet modeling. In operation, the computer processor 920 executes a plurality of instructions stored on the computer readable medium 925. As a result, the computer 905 communicates with the printer 910, causing the printer 910 to manufacture the springs 175, 350, 400, 500, 606, 805, and 855 or at least a portion thereof. In one or more example embodiments, manufacturing the springs 175, 350, 400, 500, 606, 805, and 855 and/or portions of the valve assembly 135 using the system 900 results in an integrally formed springs 175, 350, 400, 500, 606, 805, and 855 and/or portions of the valve assembly 135.

Figure 40:
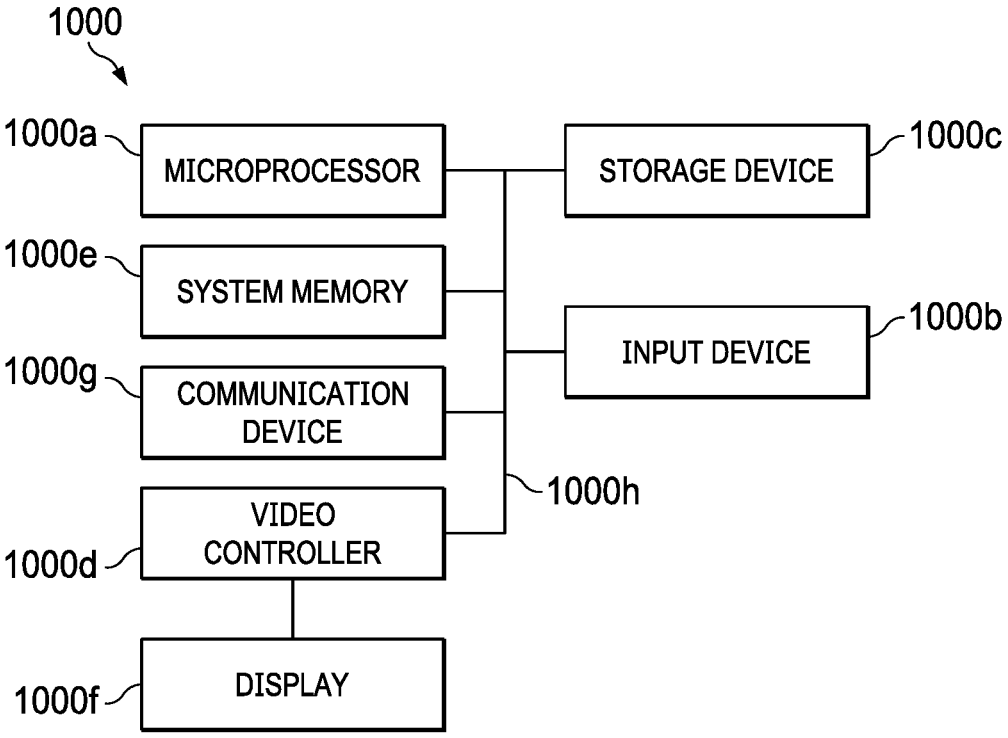
FIG. 40 is a diagrammatic illustration of a node for implementing one or more example embodiments of the present disclosure, according to an example embodiment.

In one or more exemplary embodiments, as illustrated in FIG. 40 with continuing reference to FIGS. 1-39, an illustrative computing device 1000 for implementing one or more embodiments of one or more of the above-described networks, elements, methods and/or steps, and/or any combination thereof, is depicted. The computing device 1000 includes a processor 1000*a*, an input device 1000*b*, a storage device 1000*c*, a video controller 1000*d*, a system memory 1000*e*, a display 1000*f*, and a communication device 1000*g*, all of which are interconnected by one or more buses 1000*h*. In several exemplary embodiments, the storage device 1000*c* may include a floppy drive, hard drive, CD-ROM, optical drive, any other form of storage device and/or any combination thereof. In several exemplary embodiments, the storage device 1000*c* may include, and/or be capable of receiving, a floppy disk, CD-ROM, DVD-ROM, or any other form of computer readable medium that may contain executable instructions. In one or more exemplary embodiments, the computer readable medium is a non-transitory tangible media. In several exemplary embodiments, the communication device 1000*g* may include a modem, network card, or any other device to enable the computing device 1000 to communicate with other computing devices. In several exemplary embodiments, any computing device represents a plurality of interconnected (whether by intranet or Internet) computer systems, including without limitation, personal computers, mainframes, PDAs, smartphones and cell phones.

In several exemplary embodiments, the one or more computers 905, the printer 910, and/or one or more components thereof, are, or at least include, the computing device 1000 and/or components thereof, and/or one or more computing devices that are substantially similar to the computing device 1000 and/or components thereof. In several exemplary embodiments, one or more of the above-described components of one or more of the computing device 1000, one or more computers 905, and the printer 910 and/or one or more components thereof, include respective pluralities of same components.

In several exemplary embodiments, a computer system typically includes at least hardware capable of executing machine readable instructions, as well as the software for executing acts (typically machine-readable instructions) that produce a desired result. In several exemplary embodiments, a computer system may include hybrids of hardware and software, as well as computer sub-systems.

In several exemplary embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In several exemplary embodiments, hardware may include any physical device that is capable of storing machine-readable instructions, such as memory or other data storage devices. In several exemplary embodiments, other forms of hardware include hardware sub-systems, including transfer devices such as modems, modem cards, ports, and port cards, for example.

In several exemplary embodiments, software includes any machine code stored in any memory medium, such as RAM or ROM, and machine code stored on other devices (such as floppy disks, flash memory, or a CD ROM, for example). In several exemplary embodiments, software may include source or object code. In several exemplary embodiments, software encompasses any set of instructions capable of being executed on a computing device such as, for example, on a client machine or server.

In several exemplary embodiments, combinations of software and hardware could also be used for providing enhanced functionality and performance for certain embodiments of the present disclosure. In one or more exemplary embodiments, software functions may be directly manufactured into a silicon chip. Accordingly, it should be understood that combinations of hardware and software are also included within the definition of a computer system and are thus envisioned by the present disclosure as possible equivalent structures and equivalent methods.

In several exemplary embodiments, computer readable mediums include, for example, passive data storage, such as a random-access memory (RAM) as well as semi-permanent data storage such as a compact disk read only memory (CD-ROM). One or more exemplary embodiments of the present disclosure may be embodied in the RAM of a computer to transform a standard computer into a new specific computing machine. In several exemplary embodiments, data structures are defined organizations of data that may enable an embodiment of the present disclosure. In one or more exemplary embodiments, a data structure may provide an organization of data, or an organization of executable code.

In several exemplary embodiments, the network 915, and/or one or more portions thereof, may be designed to work on any specific architecture. In one or more exemplary embodiments, one or more portions of the network 915 may be executed on a single computer, local area networks, client-server networks, wide area networks, internets, handheld and other portable and wireless devices and networks.

In several exemplary embodiments, a database may be any standard or proprietary database software, such as Oracle, Microsoft Access, Sybase, or DBase II, for example. In several exemplary embodiments, the database may have fields, records, data, and other database elements that may be associated through database specific software. In several exemplary embodiments, data may be mapped. In several exemplary embodiments, mapping is the process of associating one data entry with another data entry. In one or more exemplary embodiments, the data contained in the location of a character file can be mapped to a field in a second table. In several exemplary embodiments, the physical location of the database is not limiting, and the database may be distributed. In one or more exemplary embodiments, the database may exist remotely from the server, and run on a separate platform. In one or more exemplary embodiments, the database may be accessible across the Internet. In several exemplary embodiments, more than one database may be implemented.

In several exemplary embodiments, a computer program, such as a plurality of instructions stored on a computer readable medium, such as the computer readable medium 925, the system memory 1000*e*, and/or any combination thereof, may be executed by a processor to cause the processor to carry out or implement in whole or in part the operation of the system 900, and/or any combination thereof. In several exemplary embodiments, such a processor may include one or more of the computer processor 920, the processor 1000*a*, and/or any combination thereof. In several exemplary embodiments, such a processor may execute the plurality of instructions in connection with a virtual computer system.

In several exemplary embodiments, a plurality of instructions stored on a computer readable medium may be executed by one or more processors to cause the one or more processors to carry out or implement in whole or in part the above-described operation of each of the above-described exemplary embodiments of the system, the method, and/or any combination thereof. In several exemplary embodiments, such a processor may include one or more of the microprocessor 1000*a*, any processor(s) that are part of the components of the system, and/or any combination thereof, and such a computer readable medium may be distributed among one or more components of the system. In several exemplary embodiments, such a processor may execute the plurality of instructions in connection with a virtual computer system. In several exemplary embodiments, such a plurality of instructions may communicate directly with the one or more processors, and/or may interact with one or more operating systems, middleware, firmware, other applications, and/or any combination thereof, to cause the one or more processors to execute the instructions. In one or more exemplary embodiments, the instructions may be generated, using in part, advanced numerical method for topology optimization to determine optimum chamber shape, chamber size and distribution, and chamber density distribution for the plurality of chambers 745, or other topological features. During operation of the system 900, the computer processor 920 executes the plurality of instructions that causes the manufacture of the springs 175, 350, 400, 500, 606, and 805 and/or portions of the valve assembly 135 using additive manufacturing. Thus, the springs 175, 350, 400, 500, 606, and 805 and/or portions of the valve assembly 135 is at least partially manufactured using an additive manufacturing process. In one or more exemplary embodiments, the use of three-dimensional, or additive, manufacturing to manufacture downhole equipment, such as the springs 175, 350, 400, 500, 606, and 805 and/or portions of the valve assembly 135, will allow increased flexibility in the strategic placement of material to retain strength in one direction but reduce strength, or weaken the tool in another direction in which significant strength is not needed.

A flapper valve assembly is disclosed that includes a tubular forming an interior passageway; a valve seat forming a portion of the interior passageway; a flapper plate that is pivotably mounted to the tubular at a pivot point such that the flapper plate is pivotable between a valve closed position in which the flapper plate sealingly engages the valve seat and a valve open position in which the flapper plate does not sealingly engage the valve seat; and a spring engaging the flapper plate such that the flapper plate is biased towards the valve closed position; wherein, when the flapper plate is in the valve open position, the spring engages a top of the flapper plate at a first distance from the pivot point; wherein, when the flapper plate is in the valve closed position, the spring engages the top of the flapper plate at a second distance from the pivot point; and wherein the second distance is greater than the first distance. In one embodiment, wherein, when the flapper plate is in the valve open position, a first lever arm is defined by the first distance and a first angle of the flapper plate relative to a longitudinal axis of the interior passageway; wherein, when the flapper plate is in the valve closed position, a second lever arm is defined by the second distance and a second angle of the flapper plate relative to the longitudinal axis of the interior passageway; and wherein the second lever arm is greater than the first lever arm. In one embodiment, first and second protrusions are formed on a top surface of the flapper plate; wherein the first protrusion is spaced from the second protrusion along a longitudinal axis of the flapper plate; and wherein a portion of the spring is trapped between the first and second protrusions of the flapper plate. In one embodiment, a difference between the second distance and the first distance is based on a distance between the second protrusion and the first protrusion. In one embodiment, when the flapper plate is in the valve closed position, the portion of the first spring is engaged with the first protrusion; and wherein, when the flapper plate is in the valve open position, the portion of the first spring is engaged with the second protrusion. In one embodiment, the spring includes spaced right and left arms; wherein an end portion of the spring extends between the first arm and the second arm; wherein the end portion of the spring engages the flapper plate; wherein a cross-section of the end portion has a first shape; and wherein a cross-section of the second arm has a second shape that is different from the first shape. In one embodiment, the spring includes spaced right and left arms; wherein an end portion of the spring extends between the first arm and the second arm; wherein the end portion of the spring engages the flapper plate; wherein a cross-section of a portion of the first arm has a first shape; and wherein a cross-section of another portion of the first arm has a second shape that is different from the first shape. In one embodiment, wherein the spring includes spaced right and left arms; and wherein, when the flapper plate is in the valve closed position, each of the right and left arms extends away from the flapper plate and towards the internal shoulder. In one embodiment, wherein the spring is pinned to the tubular at a location at or near the internal shoulder.

A method of operating a flapper valve assembly is disclosed that includes a flapper plate that is biased closed relative to a valve seat using a spring, the method including: applying torque, by positioning the spring on a surface of the flapper plate, to bias the flapper plate towards a closed position relative to the valve seat; and changing the positioning of the spring relative to the surface of the flapper plate when the flapper plate moves into the closed position to increase the torque applied to the flapper plate. In one embodiment, wherein the flapper plate pivots about a pivot point when moving between the closed position and an open position; and wherein changing the positioning of the spring relative to the surface of the flapper plate when the flapper plate moves into the closed position includes increasing a distance between the spring and the pivot point. In one embodiment, wherein first and second protrusions are formed on the surface of the flapper plate; wherein the first protrusion is spaced from the second protrusion along a longitudinal axis of the flapper plate; wherein an end portion of the spring is trapped between the first and second protrusions of the flapper plate; wherein, when in the open position, the end portion of the spring contacts the second protrusion; and wherein, increasing the distance between the spring and the pivot point includes moving the end portion of the spring such that the end portion no longer contacts the second protrusion and contacts the first protrusion. In one embodiment, wherein increasing the distance is a function of the spacing between the second protrusion and the first protrusion. In one embodiment, wherein the spring includes spaced right and left arms; wherein an end portion of the spring extends between the first arm and the second arm; wherein the end portion of the spring engages the flapper plate; wherein a cross-section of the end portion has a first shape; and wherein a cross-section of the second arm has a second shape that is different from the first shape. In one embodiment, wherein the spring includes spaced right and left arms; wherein an end portion of the spring extends between the first arm and the second arm; wherein the end portion of the spring engages the flapper plate; wherein a cross-section of a portion of the first arm has a first shape; and wherein a cross-section of another portion of the first arm has a second shape that is different from the first shape. In one embodiment, wherein the flapper valve assembly further includes a tubular forming an interior passageway and including an internal shoulder; wherein the spring includes spaced right and left arms; wherein the valve seat forms a portion of the interior passageway and is spaced from the internal shoulder to form a flapper chamber; wherein the flapper plate is pivotably mounted to the tubular at a pivot point and positioned within the flapper chamber; and wherein, when the flapper plate is in the closed position, each of the right and left arms extends away from the flapper plate and towards the internal shoulder. In one embodiment, further including changing the positioning of the spring relative to the surface of the flapper plate when the flapper plate moves into the open position. In one embodiment, wherein changing the positioning of the spring relative to the surface of the flapper plate when the flapper plate moves into the open position includes decreasing the distance between the spring and the pivot point. In one embodiment, wherein first and second protrusions are formed on the surface of the flapper plate; wherein the first protrusion is spaced from the second protrusion along a longitudinal axis of the flapper plate; wherein an end portion of the spring is trapped between the first and second protrusions of the flapper plate; wherein, when in the closed position, the end portion of the spring contacts the first protrusion; and wherein, changing the positioning of the spring relative to the surface of the flapper plate when the flapper plate moves into the open position includes moving the end portion of the spring such that the end portion no longer contacts the first protrusion and contacts the second protrusion. In one embodiment, wherein the spring is pinned to the tubular at a location at or near the internal shoulder; and wherein changing the positioning of the spring relative to the surface of the flapper plate when the flapper plate moves into the closed position further includes pivoting the spring about the location.

It is understood that variations may be made in the foregoing without departing from the scope of the disclosure. Furthermore, the elements and teachings of the various illustrative example embodiments may be combined in whole or in part in some or all of the illustrative example embodiments. In addition, one or more of the elements and teachings of the various illustrative example embodiments may be omitted, at least in part, and/or combined, at least in part, with one or more of the other elements and teachings of the various illustrative embodiments.

Any spatial references such as, for example, "upper," "lower," "above," "below," "between," "vertical," "horizontal," "angular," "upwards," "downwards," "side-to-side," "left-to-right," "right-to-left," "top-to-bottom," "bottom-to-top," "top," "bottom," "bottom-up," "top-down," "front-to-back," etc., are for the purpose of illustration only and do not limit the specific orientation or location of the structure described above.

In several example embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several example embodiments have been described in detail above, the embodiments described are examples only and are not limiting, and those skilled in the art will readily appreciate that many other modifications, changes, and/or substitutions are possible in the example embodiments without materially departing from the novel teachings and advantages of the present disclosure. Accordingly, all such modifications, changes, and/or substitutions are intended to be included within the scope of this disclosure as defined in the following claims. In the claims, means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What we claim is:

1. A flapper valve assembly, comprising:

a tubular forming an interior passageway;

a valve seat forming a portion of the interior passageway;

a flapper plate that is pivotably mounted to the tubular at a pivot point such that the flapper plate is pivotable between a valve closed position in which the flapper plate sealingly engages the valve seat and a valve open position in which the flapper plate does not sealingly engage the valve seat; and a spring engaging the flapper plate such that the flapper plate is biased towards the valve closed position;

wherein, when the flapper plate is in the valve open position, the spring engages a top surface of the flapper plate at a first position that is a first distance from the pivot point;

wherein, when the flapper plate is in the valve closed position, the spring engages the top surface of the flapper plate at a second position that is a second distance from the pivot point; and wherein the second distance is greater than the first distance.

2. The flapper valve assembly of claim 1, wherein, when the flapper plate is in the valve open position, a first lever arm is defined by the first distance and a first angle of the flapper plate relative to a longitudinal axis of the interior passageway;

wherein, when the flapper plate is in the valve closed position, a second lever arm is defined by the second distance and a second angle of the flapper plate relative to the longitudinal axis of the interior passageway; and wherein the second lever arm is greater than the first lever arm.

3. The flapper valve assembly of claim 2, wherein the spring comprises spaced right and left arms;

wherein an end portion of the spring extends between the first arm and the second arm;

wherein the end portion of the spring engages the flapper plate;

wherein a cross-section of the end portion has a first shape; and wherein a cross-section of the second arm has a second shape that is different from the first shape.

4. The flapper valve assembly of claim 2, wherein the spring comprises spaced right and left arms;

wherein an end portion of the spring extends between the first arm and the second arm;

wherein the end portion of the spring engages the flapper plate;

wherein a cross-section of a portion of the first arm has a first shape; and wherein a cross-section of another portion of the first arm has a second shape that is different from the first shape.

5. The flapper valve assembly of claim 1, wherein first and second protrusions are formed on the top surface of the flapper plate;

wherein the first protrusion is spaced from the second protrusion along a longitudinal axis of the flapper plate; and wherein a portion of the spring is trapped between the first and second protrusions of the flapper plate.

6. The flapper valve assembly of claim 5, wherein a difference between the second distance and the first distance is based on a distance between the second protrusion and the first protrusion.

7. The flapper valve assembly of claim 5, wherein, when the flapper plate is in the valve closed position, the portion of the first spring is engaged with the first protrusion; and wherein, when the flapper plate is in the valve open position, the portion of the first spring is engaged with the second protrusion.

8. The flapper valve assembly of claim 1, wherein the spring comprises spaced right and left arms; and wherein, when the flapper plate is in the valve closed position, each of the right and left arms extends away from the flapper plate and towards the internal shoulder.

9. The flapper valve assembly of claim 1, wherein the spring is pinned to the tubular at a location at or near the internal shoulder.

10. A method of operating a flapper valve assembly that comprises a flapper plate that is biased closed relative to a valve seat using a spring, the method comprising:

applying torque, by positioning the spring on a surface of the flapper plate, to bias the flapper plate towards a closed position relative to the valve seat; and changing the positioning of the spring relative to the surface of the flapper plate when the flapper plate moves into the closed position to increase the torque applied to the flapper plate;

wherein the flapper plate pivots about a pivot point when moving between the closed position and an open position; and wherein changing the positioning of the spring relative to the surface of the flapper plate when the flapper plate moves into the closed position comprises increasing a distance between the pivot point and a contact point between the spring the surface of the flapper plate.

11. The method of claim 10, wherein first and second protrusions are formed on the surface of the flapper plate;

wherein the first protrusion is spaced from the second protrusion along a longitudinal axis of the flapper plate;

wherein an end portion of the spring is trapped between the first and second protrusions of the flapper plate;

wherein, when in the open position, the end portion of the spring contacts the second protrusion; and wherein, increasing the distance between the pivot point and the contact point between the spring the surface of the flapper plate comprises moving the end portion of the spring such that the end portion no longer contacts the second protrusion and contacts the first protrusion.

12. The method of claim 11, wherein increasing the distance is a function of the spacing between the second protrusion and the first protrusion.

13. The method of claim 10, wherein the spring comprises spaced right and left arms;

wherein an end portion of the spring extends between the first arm and the second arm;

wherein the end portion of the spring engages the flapper plate;

wherein a cross-section of the end portion has a first shape; and wherein a cross-section of the second arm has a second shape that is different from the first shape.

14. The method of claim 10, wherein the spring comprises spaced right and left arms;

wherein an end portion of the spring extends between the first arm and the second arm;

wherein the end portion of the spring engages the flapper plate;

wherein a cross-section of a portion of the first arm has a first shape; and wherein a cross-section of another portion of the first arm has a second shape that is different from the first shape.

15. The method of claim 10, wherein the flapper valve assembly further comprises a tubular forming an interior passageway and comprising an internal shoulder;

wherein the spring comprises spaced right and left arms;

wherein the valve seat forms a portion of the interior passageway and is spaced from the internal shoulder to form a flapper chamber;

wherein the flapper plate is pivotably mounted to the tubular at the pivot point and positioned within the flapper chamber; and wherein, when the flapper plate is in the closed position, each of the right and left arms extends away from the flapper plate and towards the internal shoulder.

16. The method of claim 15, wherein the spring is pinned to the tubular at a location at or near the internal shoulder; and wherein changing the positioning of the spring relative to the surface of the flapper plate when the flapper plate moves into the closed position further comprises pivoting the spring about the location.

17. The method of claim 10, further comprising changing the positioning of the spring relative to the surface of the flapper plate when the flapper plate moves into the open position.

18. The method of claim 17, wherein changing the positioning of the spring relative to the surface of the flapper plate when the flapper plate moves into the open position comprises decreasing the distance between the pivot point and the contact point between the spring the surface of the flapper plate.

19. The method of claim 17, wherein first and second protrusions are formed on the surface of the flapper plate;

wherein the first protrusion is spaced from the second protrusion along a longitudinal axis of the flapper plate;

wherein an end portion of the spring is trapped between the first and second protrusions of the flapper plate;

wherein, when in the closed position, the end portion of the spring contacts the first protrusion; and wherein, changing the positioning of the spring relative to the surface of the flapper plate when the flapper plate moves into the open position comprises moving the end portion of the spring such that the end portion no longer contacts the first protrusion and contacts the second protrusion.

* * * * *